US011199197B2

(12) United States Patent
Yang et al.

(10) Patent No.: US 11,199,197 B2
(45) Date of Patent: Dec. 14, 2021

(54) CENTRIFUGAL FAN

(71) Applicant: Delta Electronics, Inc., Taoyuan (TW)

(72) Inventors: Chao-Fu Yang, Taoyuan (TW); Shao-Ning Lee, Taoyuan (TW); Chih-Chung Chen, Taoyuan (TW); Shun-Chen Chang, Taoyuan (TW); Kuo-Tung Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 51 days.

(21) Appl. No.: 16/793,894

(22) Filed: Feb. 18, 2020

(65) Prior Publication Data

US 2021/0071682 A1 Mar. 11, 2021

Related U.S. Application Data

(60) Provisional application No. 62/896,731, filed on Sep. 6, 2019.

(51) Int. Cl.
*F04D 29/44* (2006.01)
*F04D 29/42* (2006.01)
*F04D 29/28* (2006.01)

(52) U.S. Cl.
CPC ..... *F04D 29/4246* (2013.01); *F04D 29/281* (2013.01)

(58) Field of Classification Search
CPC ..... F04D 29/281; F04D 29/4213; F04D 29/4226; F04D 29/424; F04D 29/4246; F05D 2250/51; F05D 2250/52
See application file for complete search history.

(56) References Cited

U.S. PATENT DOCUMENTS 5,352,099 A * 10/1994 Anstine ..... F04D 17/165 122/13.01
7,887,290 B2 * 2/2011 Chen ..... F04D 29/663 415/206
8,616,158 B2 * 12/2013 Garrett ..... F04D 29/441 122/18.31
9,512,856 B2 * 12/2016 Nibu ..... A61M 16/0069
(Continued)

FOREIGN PATENT DOCUMENTS

CN 201110279 Y 9/2008
CN 101813096 A 8/2010
(Continued)

*Primary Examiner* — Ninh H. Nguyen
(74) *Attorney, Agent, or Firm* — Kirton McConkie; Evan R. Witt

(57) ABSTRACT

A centrifugal fan is provided and includes an impeller, a motor, a first case and a second case. The motor is connected with the impeller to drive the impeller to rotate. The first case and the second case are assembled to form an accommodation space for accommodating the impeller and the motor. The first case includes a first side, a first guiding wall, a flow inlet and a flow outlet. The flow inlet is disposed on the first side, the first guiding wall is connected with the first side, and the flow outlet and the flow inlet are located at a same side of the centrifugal fan. The second case includes a second side and a second guiding wall connected with the second side. The first guiding wall and the second guiding wall are assembled to form a flow guiding channel, which has cross-sectional areas with different sizes.

17 Claims, 35 Drawing Sheets

(56) References Cited

U.S. PATENT DOCUMENTS

| | | | | |
|---|---|---|---|---|
| 9,874,212 | B2 * | 1/2018 | Theelen | F04D 29/582 |
| 2011/0110774 | A1 | 5/2011 | Horng et al. | |

FOREIGN PATENT DOCUMENTS

| | | | | |
|---|---|---|---|---|
| CN | 201916252 | U | 8/2011 | |
| CN | 202194839 | U | 4/2012 | |
| CN | 203248373 | U | 10/2013 | |
| CN | 104963894 | A | 10/2015 | |
| CN | 205858739 | U | 1/2017 | |
| CN | 107401516 | A | 11/2017 | |
| TW | 555068 | U | 9/2003 | |
| TW | M309846 | U | 4/2007 | |
| WO | WO-2019056676 | A1 * | 3/2019 | F04D 25/08 |

* cited by examiner

1

1

1i

1j

CENTRIFUGAL FAN

CROSS-REFERENCE TO RELATED APPLICATION

This application claims the benefit of U.S. Provisional Application No. 62/896,731 filed on Sep. 6, 2019, and entitled "CENTRIFUGAL FAN". The entireties of the above-mentioned patent application are incorporated herein by reference for all purposes.

FIELD OF THE INVENTION

The present disclosure relates to a centrifugal fan, and more particularly to a centrifugal fan having a flow inlet and a flow outlet located at the same side.

BACKGROUND OF THE INVENTION

In recent years, fan structures have been widely used in air transportation systems for vehicles. Since a centrifugal fan has the advantages of compact structure, low power consumption and low noise, it is suitable for circulating air in the vehicle.

However, the conventional centrifugal fan is designed to have an axial flow inlet and a lateral flow outlet or a lateral flow inlet and an axial flow outlet. When the centrifugal fan is installed in a limited and closed space, such as in a vehicle, a sufficient space should be provided, so as to allow the air to flow between the flow inlet and the flow outlet. If one of the flow inlet and the flow outlet is blocked, the function of the centrifugal fan cannot be achieved, and the air in the vehicle cannot be circulated sufficiently.

Furthermore, since the flow inlet and the flow outlet of the conventional centrifugal fan are located at two different sides, respectively, if an external device, such as a PM2.5 particle detecting device, is to be combined to monitor the air in the vehicle, the external device is disposed adjacent to one of the flow inlet and the flow outlet, and a large space is required for combination. Moreover, the external device for monitoring the air in the vehicle is not easy to compare the difference of the air between the flow inlet and the flow outlet.

Therefore, there is a need of providing a centrifugal fan to enhance the air transportation efficiency and address the above issues encountered by the prior arts.

SUMMARY OF THE DISCLOSURE

An object of the present disclosure is to provide a centrifugal fan. By disposing a flow inlet and a flow outlet on a same side of the centrifugal fan, when the centrifugal fan is installed in a limited space, such as in a vehicle, it is beneficial to reduce the installation space required for the centrifugal fan. At the same time, the efficiency of air transportation of the centrifugal fan is not influenced due to the limited installation space. In addition, when the centrifugal fan is combined with an external device, for example a PM2.5 particle detecting device to monitor the air quality inside the vehicle, the external device has advantages of monitoring the air quality located at the flow inlet and the flow outlet and obtaining the difference therebetween.

Another object of the present disclosure is to provide a centrifugal fan. The guiding channel of the centrifugal fan has cross-sectional areas with different sizes, which is beneficial to enhance the efficiency of air transportation between the flow inlet and the flow outlet. The cross-sectional areas in the direction of airflow in the centrifugal fan are gradually reduced, it is beneficial to increase the pressure of the airflow and increase the flow rate. Furthermore, with the arrangement of misaligning the rotating center of the impeller and the flow inlet, it is more advantageous of enhancing the transportation efficiency of the centrifugal fan.

A further object of the present disclosure is to provide a centrifugal fan. The fan case and the guiding tube are integrally formed or detachably connected to each other according to practical requirements. Moreover, a pressurized assembly and a branch tube are selectively combined with the flow inlet and the flow outlet to increase the practicality of the centrifugal fan, so that the market competitiveness of the centrifugal fan is enhanced.

In accordance with an aspect of the present disclosure, a centrifugal fan is provided and includes an impeller, a motor, a first case and a second case. The motor is connected with the impeller and configured to drive the impeller to rotate. The first case includes a first side, a first guiding wall, a flow inlet and a flow outlet. The second case includes a second side, a second guiding wall. The first side and the second side are opposite to each other, and assembled with each other through the first guiding wall and the second guiding wall to form an accommodation space and a flow guiding channel. The first guiding wall and the second guiding wall spatially correspond to each other, and respectively include a guiding portion configured together to form the guiding channel. The flow outlet and the flow inlet are located at a same side of the centrifugal fan. The flow inlet, the flow outlet and the impeller have axial lines extending in a same direction. The impeller and the motor are accommodated within the accommodation space. The flow guiding channel is in fluid communication between the accommodation space and the flow outlet.

In accordance with another aspect of the present disclosure, a centrifugal fan is provided and includes an impeller, a motor, a first case and a second case. The motor is connected with the impeller and configured to drive the impeller to rotate. The first case and the second case are assembled with each other to form an accommodation space, wherein the impeller and the motor are accommodated within the accommodation space. The first case includes a first side, a first guiding wall, a flow inlet and a flow outlet, the flow inlet is disposed on the first side, and the first guiding wall is connected with the first side. The second case includes a second side and a second guiding wall, and the second guiding wall is connected with the second side. The first guiding wall and the second guiding wall are assembled with each other to form a guiding channel, the flow guiding channel is in fluid communication between the accommodation space and the flow outlet, and the flow guiding channel has cross-sectional areas with different sizes. The flow outlet and the flow inlet are located at a same side of the centrifugal fan. The flow inlet, the flow outlet and the impeller have axial lines extending in a same direction.

In accordance with a further aspect of the present disclosure, a centrifugal fan is provided and includes an impeller, a motor, a first case and a second case. The motor is connected with the impeller and configured to drive the impeller to rotate. The first case and the second case are assembled with each other to form an accommodation space. The impeller and the motor are accommodated within the accommodation space. The first case includes a first side, at least one first guiding wall, a flow inlet, at least one flow outlet and at least one guiding tube, the flow inlet is disposed on the first side, the at least one first guiding wall is extended from the first side, the at least one guiding tube is extended from the first side along a same direction where axial lines of the flow inlet and the impeller extend therein, and the at least one flow outlet is formed on an end of the at least one guiding tube. The second case includes a second side and at least one second guiding wall, and the at least one second guiding wall is connected with the second side. The at least one first guiding wall and the at least one second guiding wall are assembled with each other to form at least one flow guiding channel. The flow inlet and the at least one flow outlet are in fluid communication with each other through the accommodation space, the flow guiding channel and the at least one guiding tube, and the flow guiding channel has cross-sectional areas with different sizes.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
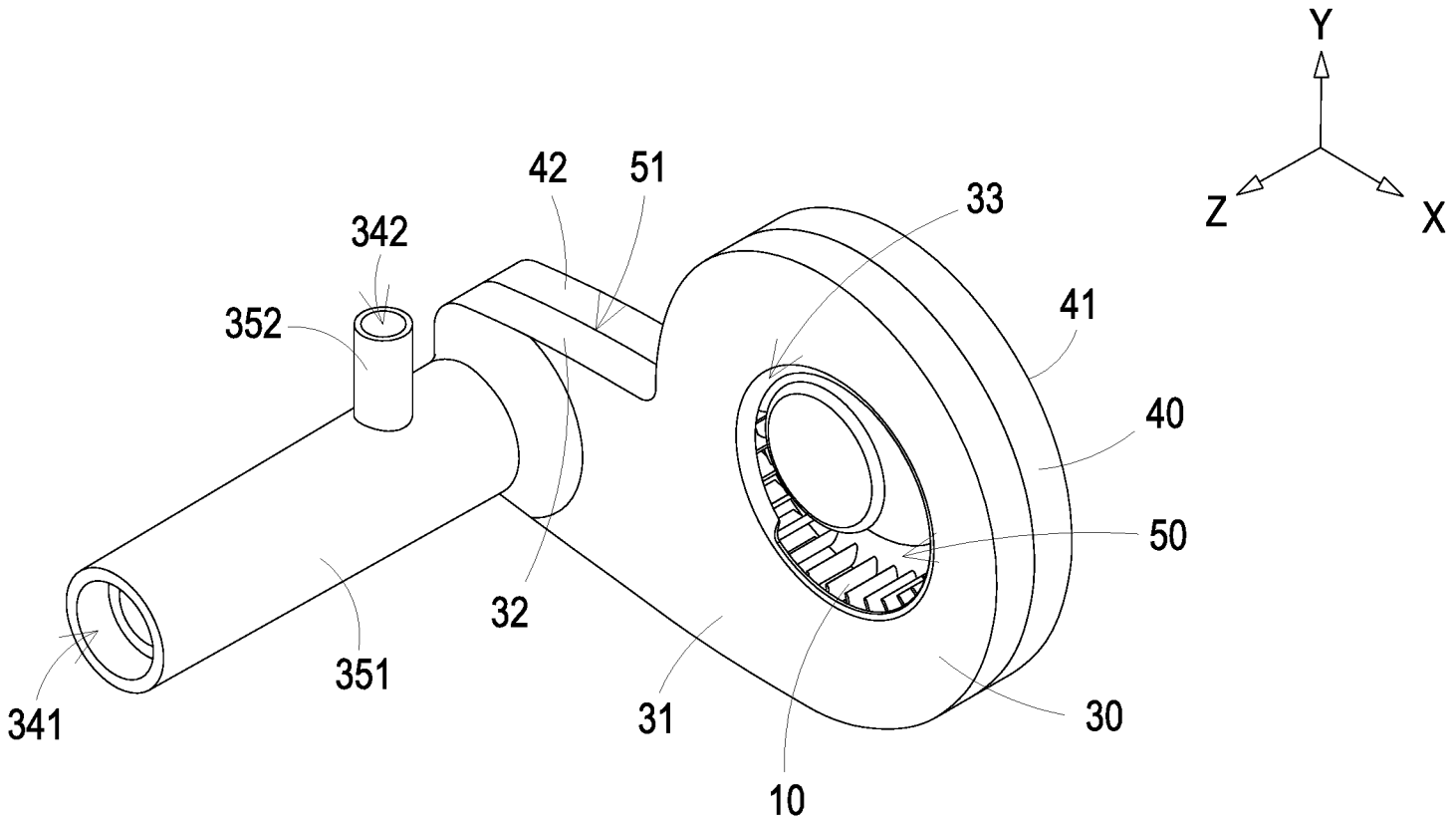
FIG. 1 is a perspective view illustrating a centrifugal fan according to a first embodiment of the present disclosure.
Figure 2:
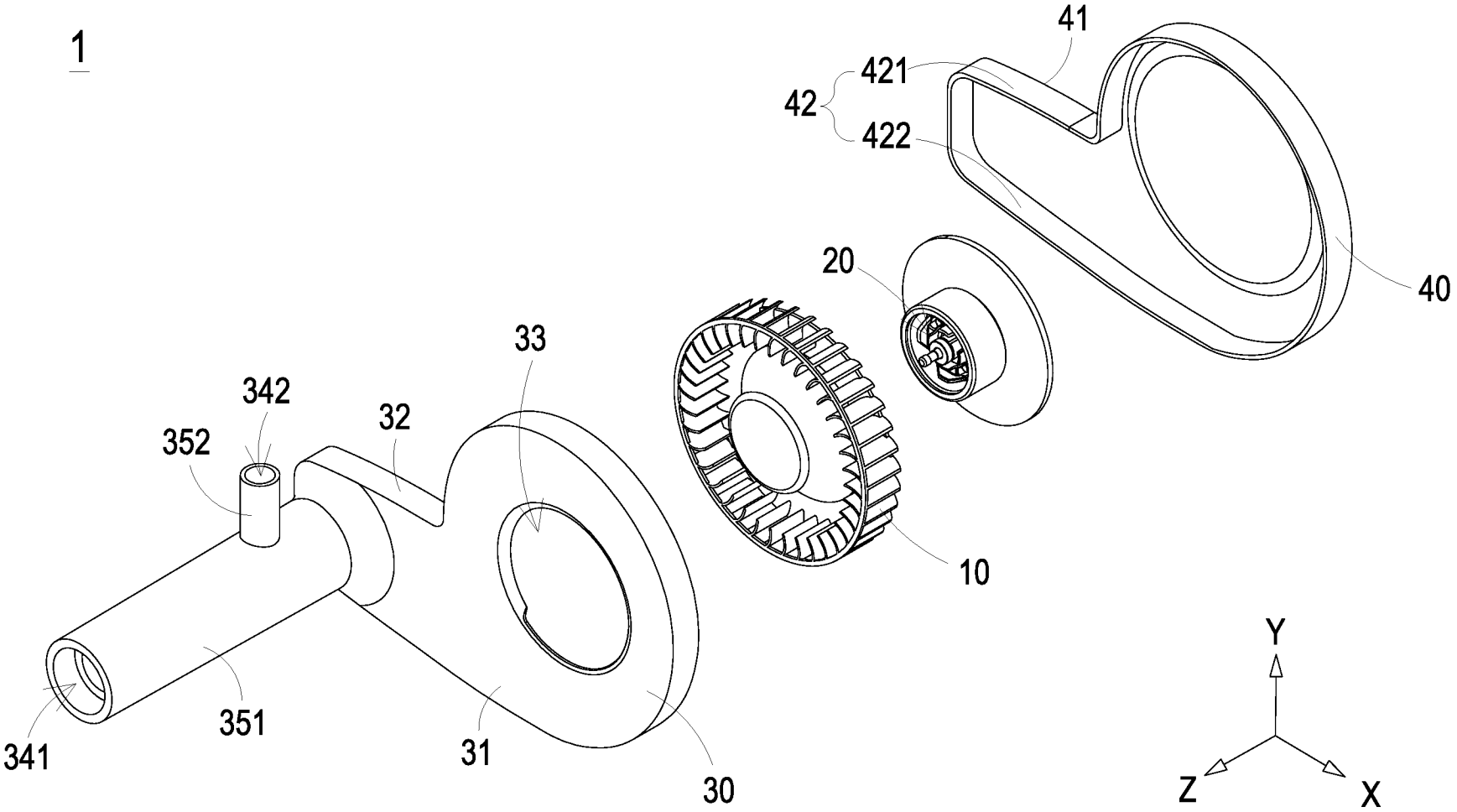
FIG. 2 is a structural exploded view illustrating the centrifugal fan according to the first embodiment of the present disclosure.
Figure 3:
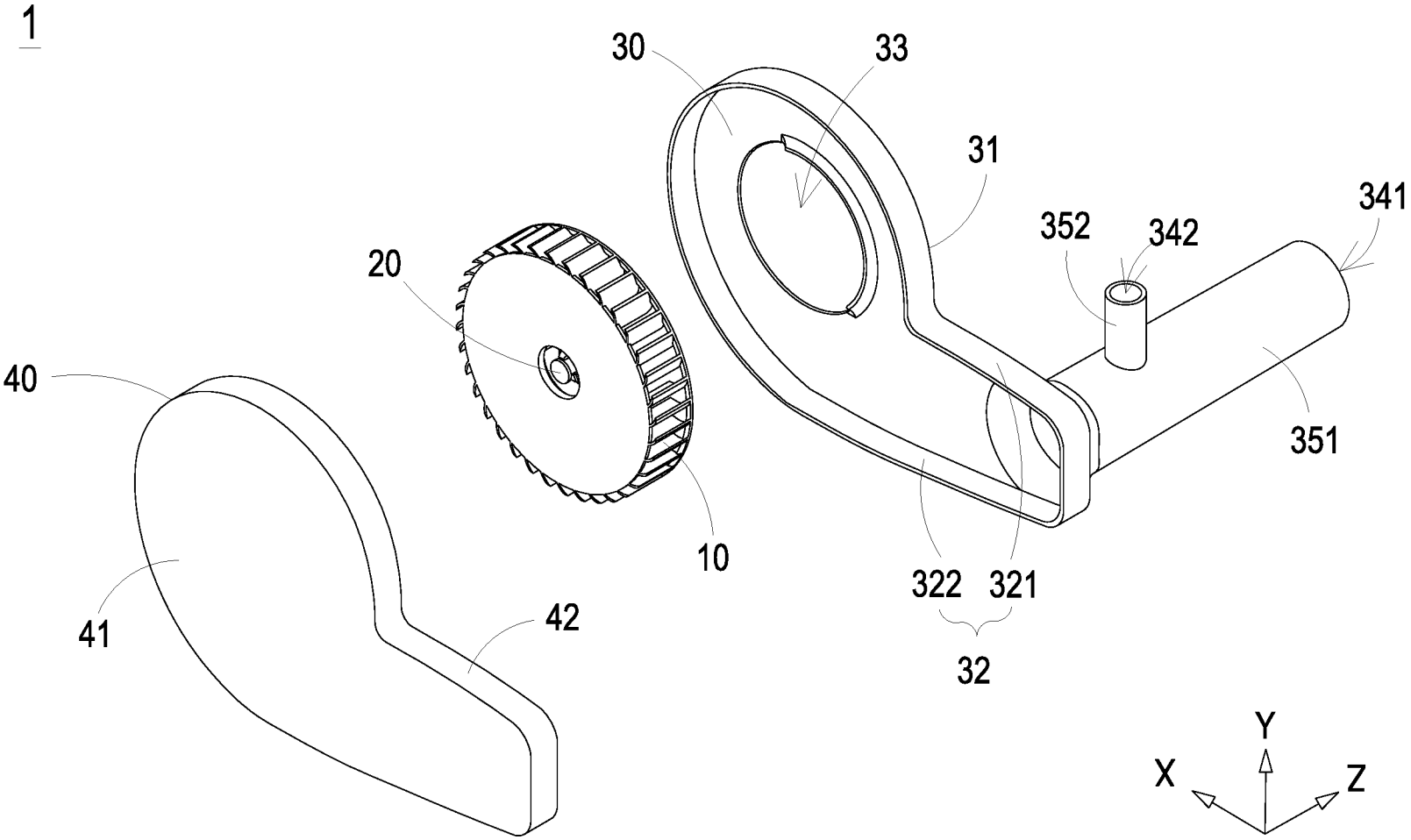
FIG. 3 is a structural exploded view illustrating the centrifugal fan according to the first embodiment of the present disclosure and taken at another viewing angle.
Figure 4:
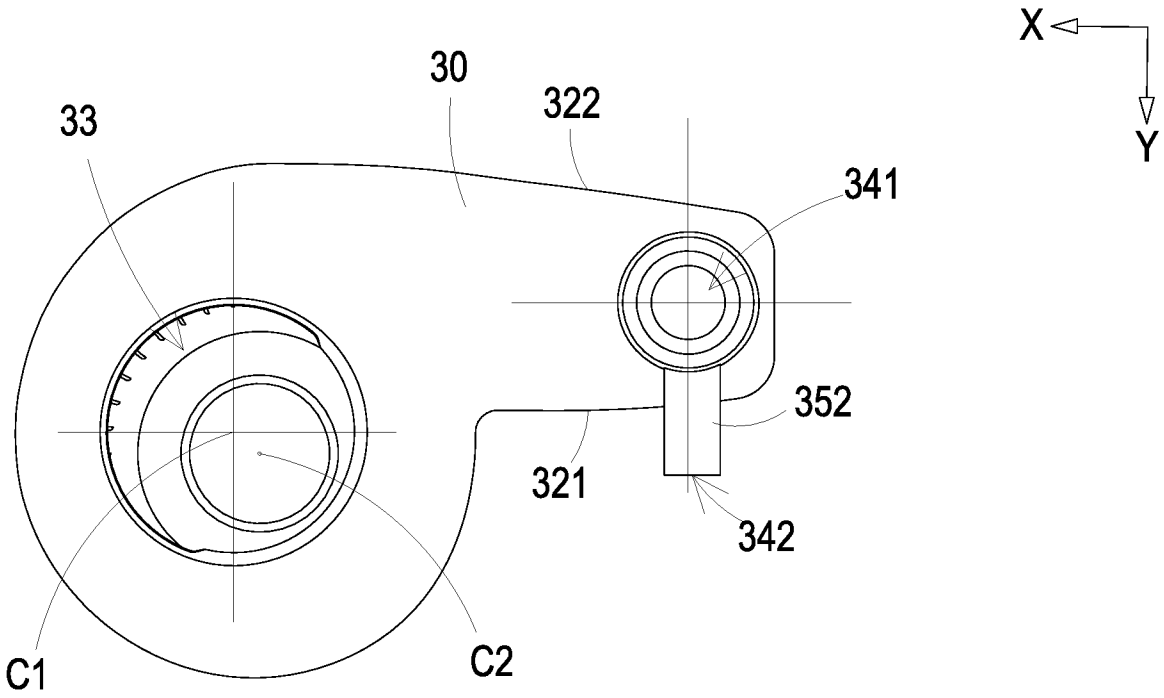
FIG. 4 is a top view illustrating the centrifugal fan according to the first embodiment of the present disclosure.

FIG. 1 is a perspective view illustrating a centrifugal fan according to a first embodiment of the present disclosure. FIGS. 2 and 3 are a structural exploded view illustrating the centrifugal fan according to the first embodiment of the present disclosure. FIG. 4 is a top view illustrating the centrifugal fan according to the first embodiment of the present disclosure. In the embodiment, the centrifugal fan 1 includes an impeller 10, a motor 20, a first case 30 and a second case 40. The motor 20 is connected with the impeller 10 and configured to drive the impeller 10 to rotate. The first case 30 and the second case 40 are assembled with each other to form an accommodation space 50. The impeller 10 and the motor 20 are accommodated within the accommodation space 50. In the embodiment, the second case 30 includes a first side 31, at least one first guiding wall 32, a flow inlet 33 and at least one first flow outlet 341. The flow inlet 33 is disposed on the first side 31. The at least one first guiding wall 32 is connected with the first side 31. The at least one first flow outlet 341 and the flow inlet 33 are located at the same side of the centrifugal fan 1. The second case 40 includes a second side 41 and at least one second guiding wall 42. The at least one second guiding wall 42 is connected with the second side 41. The first side 31 and the second side 41 are opposite to each other and assembled with each other through the at least one first guiding wall 32 and the at least one second guiding wall 42. In the embodiment, the at least one first flow outlet 341 and the flow inlet 33 are located at the first side 31 of the first case 30 and opposite to the second side 41 of the second case 40. The flow inlet 33, the at least one first flow outlet 341 and the impeller 10 have axial lines extending in a same direction. Preferably but not exclusively, the flow inlet 33, the at least one first flow outlet 341 and the impeller 10 have the axial lines extending in the Z-axis direction, so that the flow inlet 33, the at least one first flow outlet 341 and the impeller 10 have axial lines extending in the same direction. In the embodiment, the at least one first guiding wall 32 and the at least one second guiding wall 42 are assembled with each other to form at least one flow guiding channel 51 disposed on the X-Y plane. The flow guiding channel 51 is in fluid communication between the accommodation space 50 and the at least one first flow outlet 341. Preferably but not exclusively, the flow guiding channel 51 has cross-sectional areas with different sizes, so as to enhance the efficiency of air transportation between the flow inlet 33 and the at least one first flow outlet 341.

Notably, the at least one first flow outlet 341 and the flow inlet 33 are located at the same side of the centrifugal fan 1. The flow inlet 33, the at least one first flow outlet 341 and the impeller 11 have the axial lines extending in the same direction (the Z-axis direction). When the centrifugal fan 1 is installed in a limited space, such as in a vehicle, it is beneficial to reduce the installation space require for the centrifugal fan 1. At the same time, the efficiency of air transportation of the centrifugal fan 1 is not influenced due to the limited installation space. In addition, when the centrifugal fan 1 is further combined with an external device, for example a PM2.5 particle detecting device (not shown) to monitor the air quality inside the vehicle, the external device has advantages of monitoring the air quality located at the flow inlet 33 and the at least one first flow outlet 341 and obtaining the difference therebetween.

Figure 5:
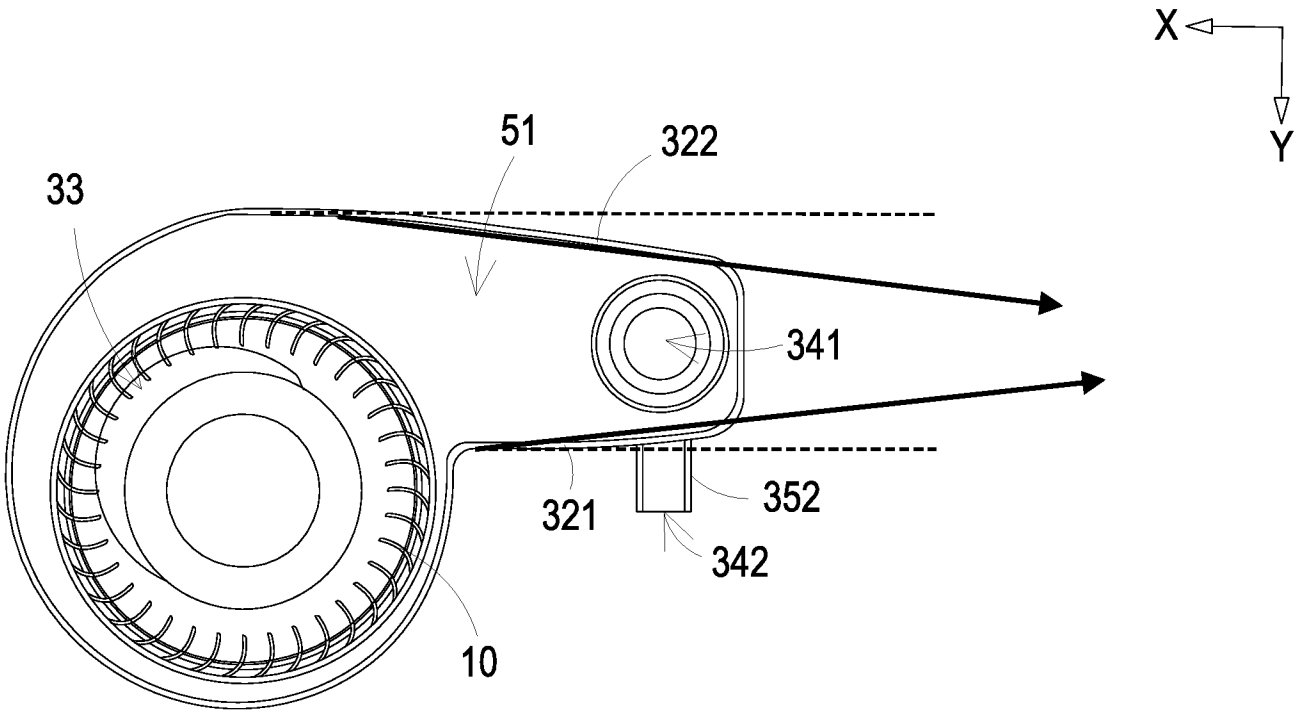
FIG. 5 is a schematic view showing the flow direction of the flow guiding channel of the centrifugal fan according to the first embodiment of the present disclosure.
Figure 6A:
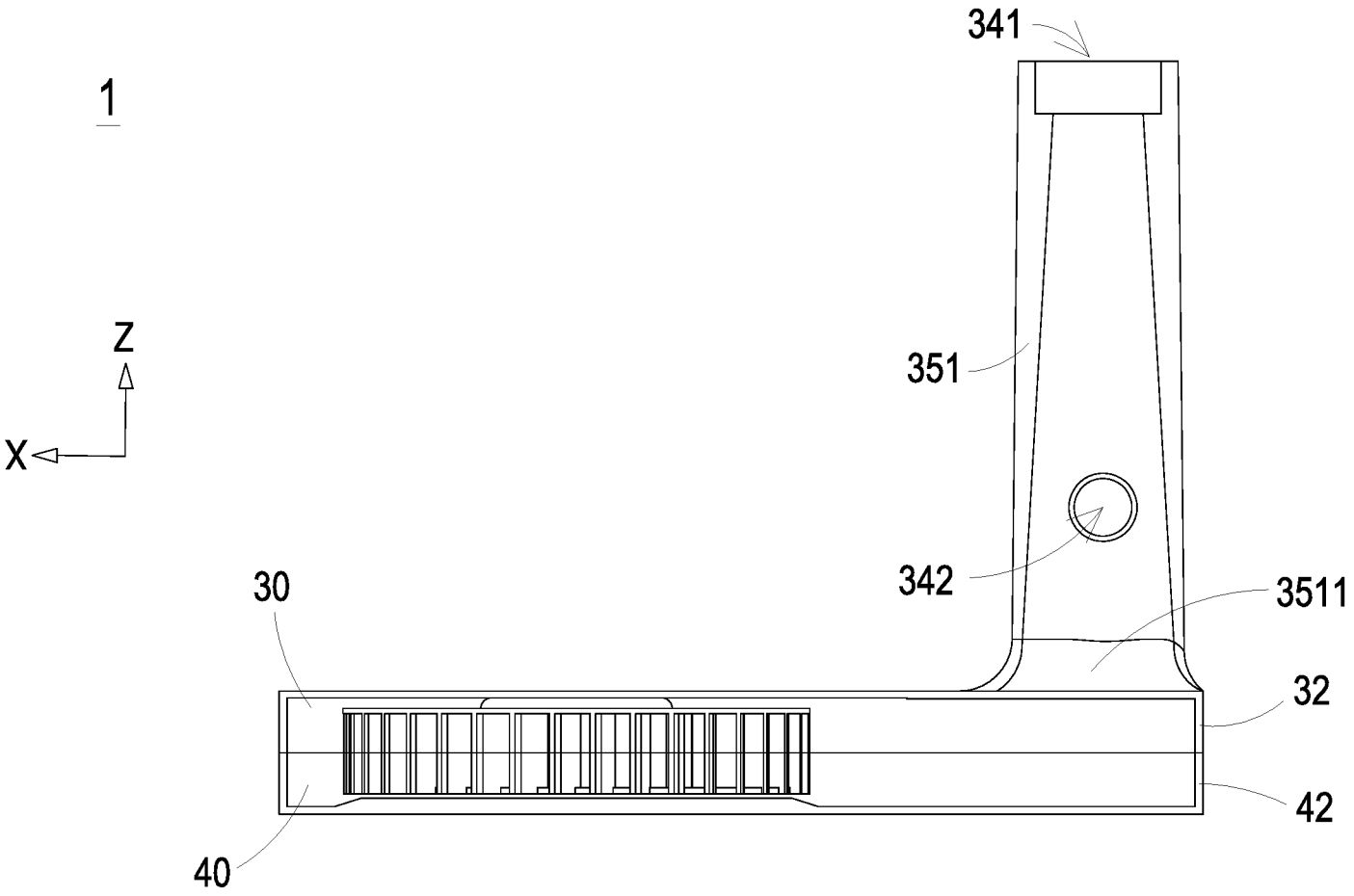
FIG. 6A is a cross-sectional view illustrating the centrifugal fan according to the first embodiment of the present disclosure.
Figure 6B:
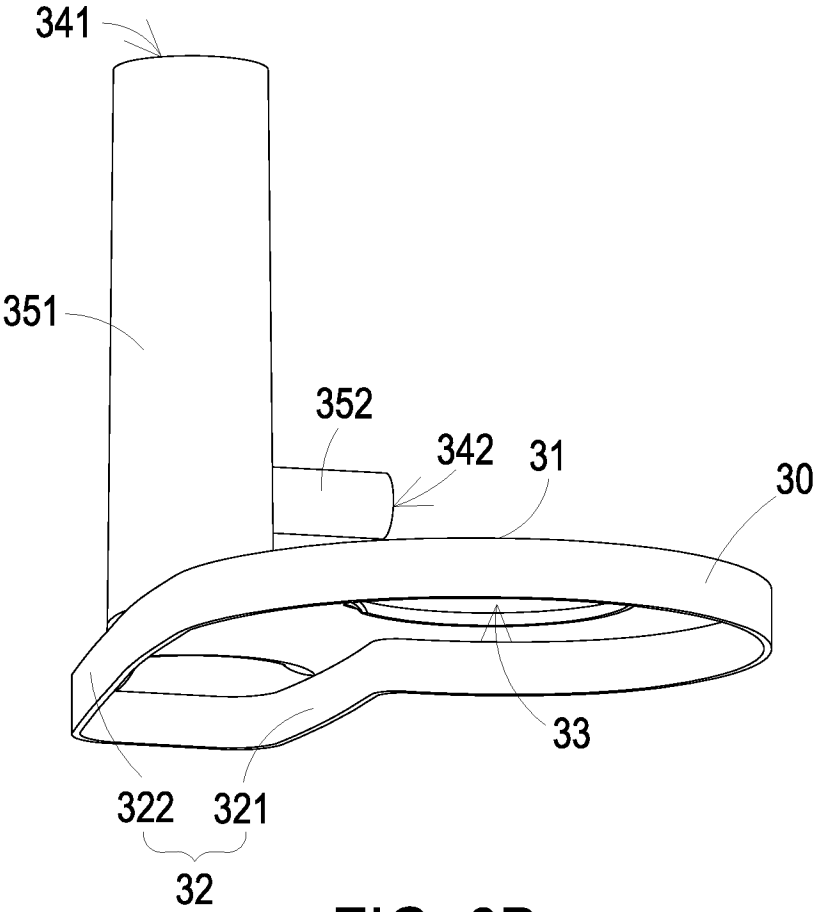
FIG. 6B is a perspective view illustrating the first case of the centrifugal fan according to the first embodiment of the present disclosure.
Figure 6C:
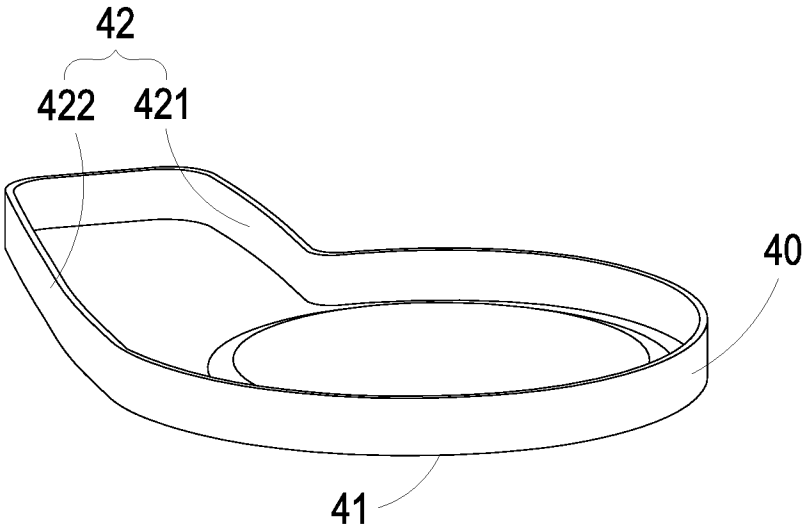
FIG. 6C is a perspective view illustrating the second case of the centrifugal fan according to the first embodiment of the present disclosure.

FIG. 5 is a schematic view showing the flow direction of the flow guiding channel of the centrifugal fan according to the first embodiment of the present disclosure. FIG. 6A is a cross-sectional view illustrating the centrifugal fan according to the first embodiment of the present disclosure. FIG. 6B is a perspective view illustrating the first case of the centrifugal fan according to the first embodiment of the present disclosure. FIG. 6C is a perspective view illustrating the second case of the centrifugal fan according to the first embodiment of the present disclosure. Referring to FIGS. 1 to 5 and FIGS. 6A to 6C, in the embodiment, the at least one first guiding wall 32 and the at least one second guiding wall 42 spatially correspond to each other. Preferably but not exclusively, the at least one first guiding wall 32 includes a pair of lateral walls 321, 322. The pair of lateral walls 321, 322 are opposite to each other, and gradually close to each other along a direction form the impeller 10 to the at least one first flow outlet 34. Preferably but not exclusively, the at least one second guiding wall 42 includes a pair of lateral walls 421, 422. The pair of lateral walls 421, 422 are opposite to each other, and gradually close to each other along the direction form the impeller 10 to the at least one first flow outlet 341, so that the sizes of the cross-sectional areas of the flow guiding channel 51 are gradually reduced. Thus, when the at least one first guiding wall 32 and the at least one second guiding wall 42 are assembled with each other, the flow guiding channel 51 is formed with the cross-sectional areas gradually reduced. It is beneficial to enhance the efficiency of air transportation between the flow inlet 33 and the at least one first flow outlet 341. Since the cross-sectional areas in the direction of airflow in the centrifugal fan 1 are gradually reduced, it is beneficial to increase the pressure of the airflow and increase the flow rate. Furthermore, in the embodiment, the impeller 10 has a rotating center C1, and the flow inlet 33 has a center C1. With the arrangement of misaligning the rotating center C2 of the impeller 10 and the center C1 of the flow inlet 33, it is more advantageous of enhancing the transportation efficiency of the centrifugal fan 1.

Figure 7:
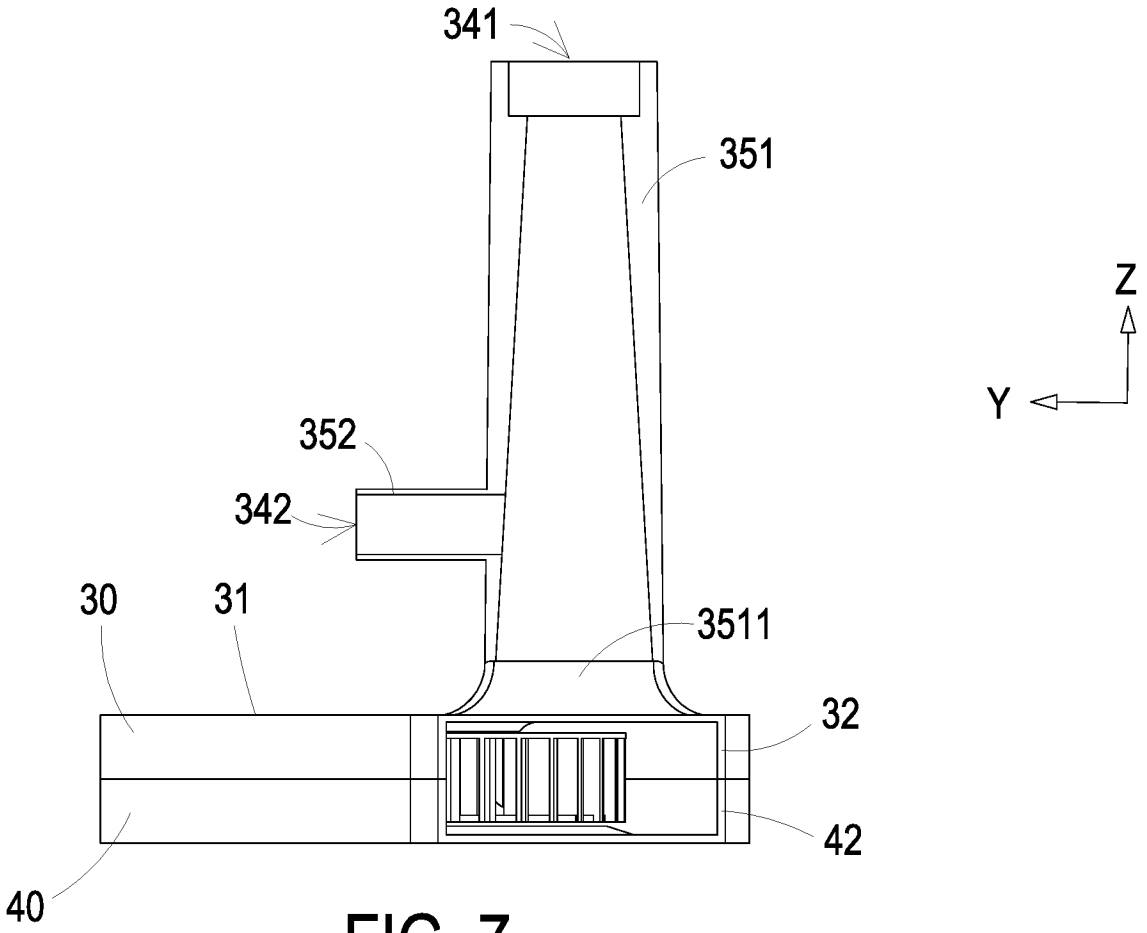
FIG. 7 is a cross-sectional view illustrating the centrifugal fan according to the first embodiment of the present disclosure and taken at another viewing angle.

FIG. 7 is a cross-sectional view illustrating the centrifugal fan according to the first embodiment of the present disclosure and taken at another viewing angle. In the embodiment, in addition to the first flow outlet 341, the first case 30 further includes a first guiding tube 351, a second flow outlet 342 and a second guiding tube 352. The at least one first guiding wall 32 is extended from the first side 31. The first guiding tube 351 is extended from the first side 31 along the same direction where the axial lines of the flow inlet 33 and the impeller 10 extend therein. The at least one flow outlet 341 is formed on an end of the first guiding tube 351. The first flow outlet 341 is in fluid communication with the accommodation space 50 through the first guiding tube 351. The second guiding tube 352 is in fluid communication between the first guiding tube 351 and the second flow outlet 342. In the embodiment, the first guiding tube 351 is in fluid communication with the accommodation space 50 through the flow guiding channel 51. Furthermore, the axial line of the first guiding tube 351 and the first flow outlet 341 and the axial line of the flow inlet 33 and the impeller extend in the same direction. Thus, the flow rate and the airflow direction of the centrifugal fan 1 is adjustable according to the practical requirements. In the embodiment, the first guiding tube 351 has an inner diameter, which is gradually decreased along a direction, for example the Z-axis direction, from the accommodation space 50 to the at least one first flow outlet 341. It is beneficial to increase the pressure of the airflow and increase the flow rate. In addition, the first guiding tub 351 includes a connection end 3511, and the connection end 3511 has an enlarged chamfer connected to the first side 31, so as to enhance the transportation efficiency. On the other hand, the second guiding tube 352 has a uniform inner diameter. Certainly, the present disclosure is not limited thereto. In the embodiment, the inner diameter of the second guiding tube 352 is less than the inner diameter of the first guiding tube 351, and the second guiding tube 352 is vertically connected to a lateral wall of the first guiding tube 351, but the present disclosure is not limited thereto.

Figure 8:
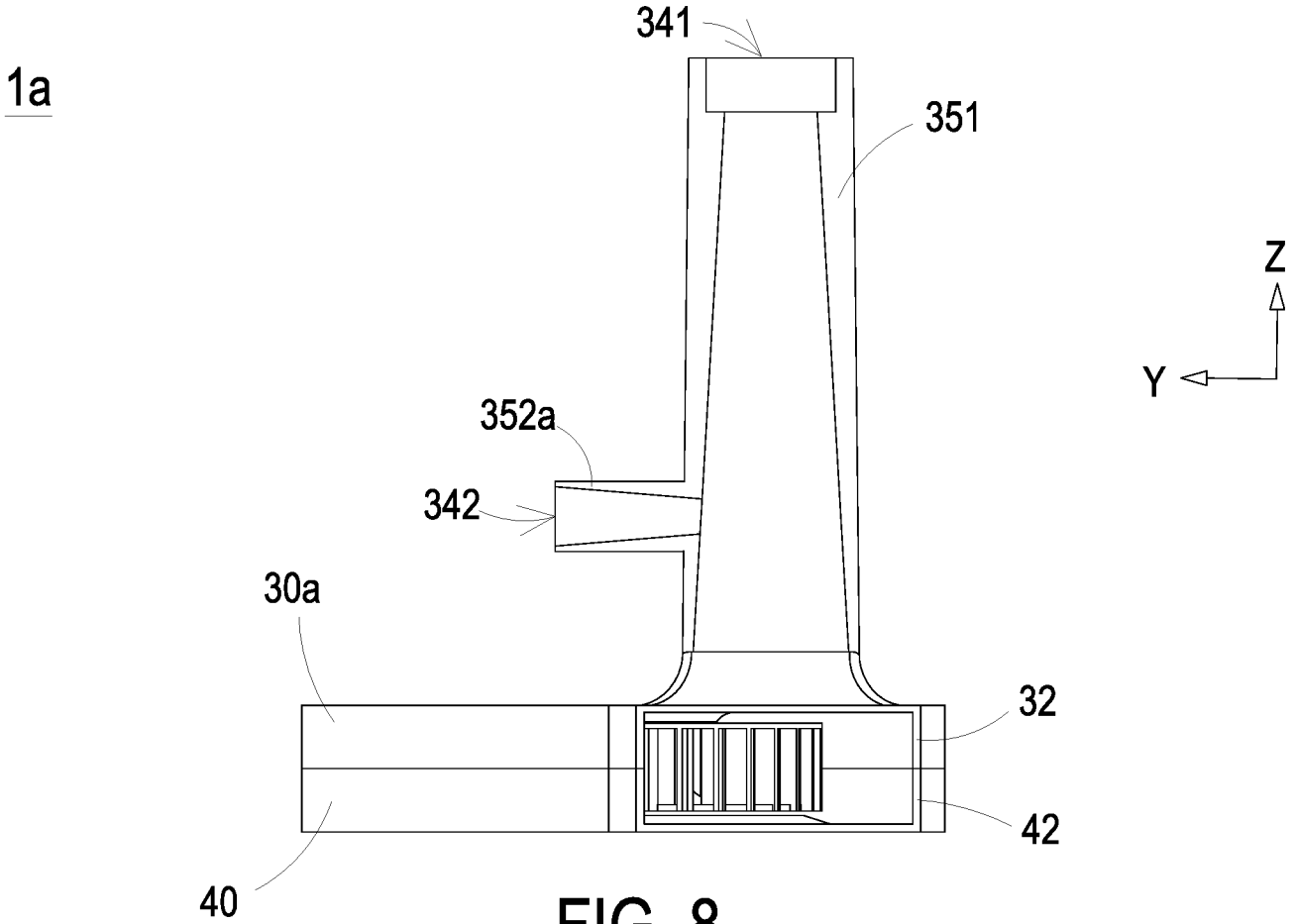
FIG. 8 is a cross-sectional view illustrating a centrifugal fan according to a second embodiment of the present disclosure.

FIG. 8 is a cross-sectional view illustrating a centrifugal fan according to a second embodiment of the present disclosure. In the embodiment, the structures, elements and functions of the centrifugal fan 1*a* are similar to those of the centrifugal fan 1 in FIGS. 1 to 7. The elements and features indicated by the numerals similar to those of the first embodiment mean similar elements and features, and are not redundantly described herein. In the embodiment, the first case 30*a* includes a first flow outlet 341, a first guiding tube 351, a second flow outlet 342 and a second guiding tube 352*a*. Different from the second guiding tube 352 of the first case 30 in the forgoing embodiment, the second guiding tube 352*a* has an inner diameter, which is gradually increased along a direction, for example the Y-axis direction, from the first guiding tube 351 to the second flow outlet 352. It is beneficial to adjust the pressure or the flow rate at the first flow outlet 341 and the second flow outlet 342. The present disclosure is not limited thereto.

Figure 9:
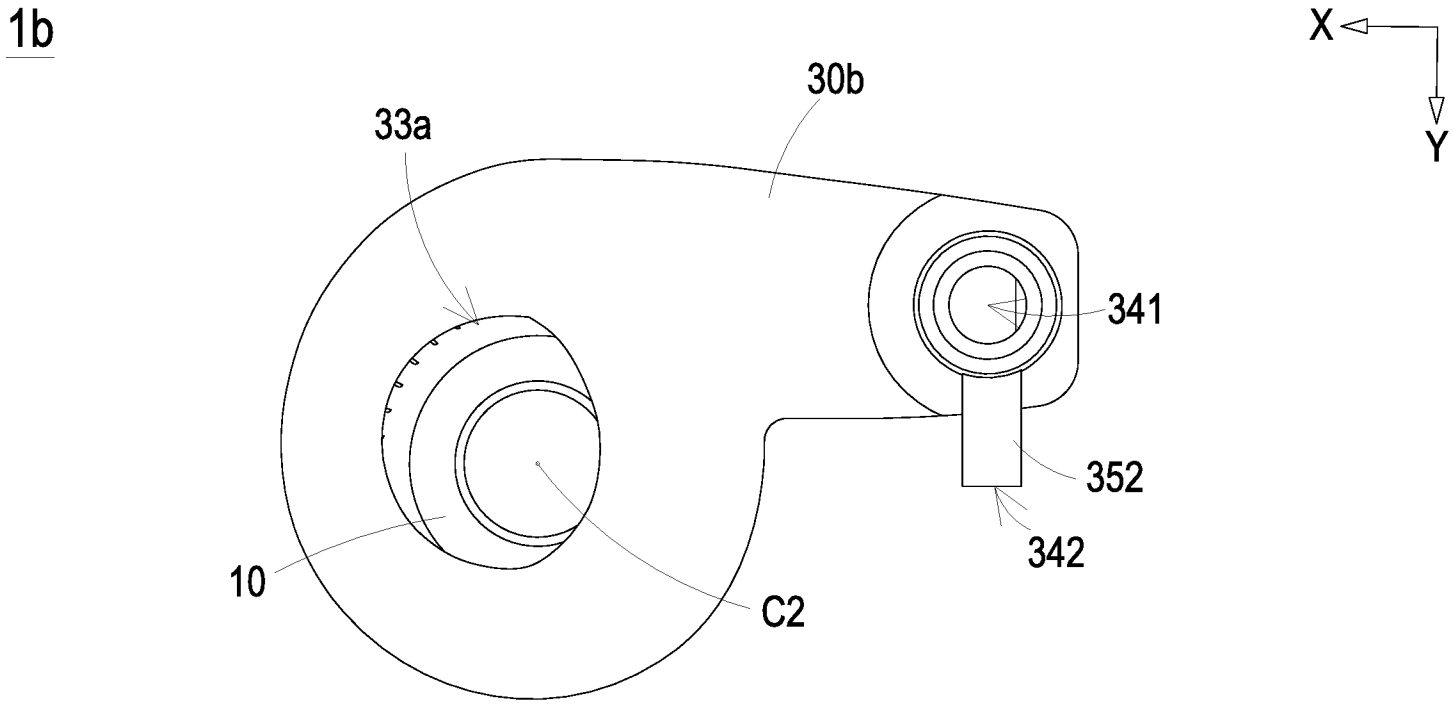
FIG. 9 is a top view illustrating a centrifugal fan according to a third embodiment of the present disclosure.

FIG. 9 is a top view illustrating a centrifugal fan according to a third embodiment of the present disclosure. In the embodiment, the structures, elements and functions of the centrifugal fan 1*b* are similar to those of the centrifugal fan 1 in FIGS. 1 to 7. The elements and features indicated by the numerals similar to those of the first embodiment mean similar elements and features, and are not redundantly described herein. In the embodiment, the flow inlet 33*a* of the first case 30*b* is non-circular and has a geometric center. The rotating center C2 of the impeller 10 and the geometric center the flow inlet 33*a* are misaligned to each other, it is more advantageous of enhancing the transportation efficiency of the centrifugal fan 1*b*.

Figure 10:
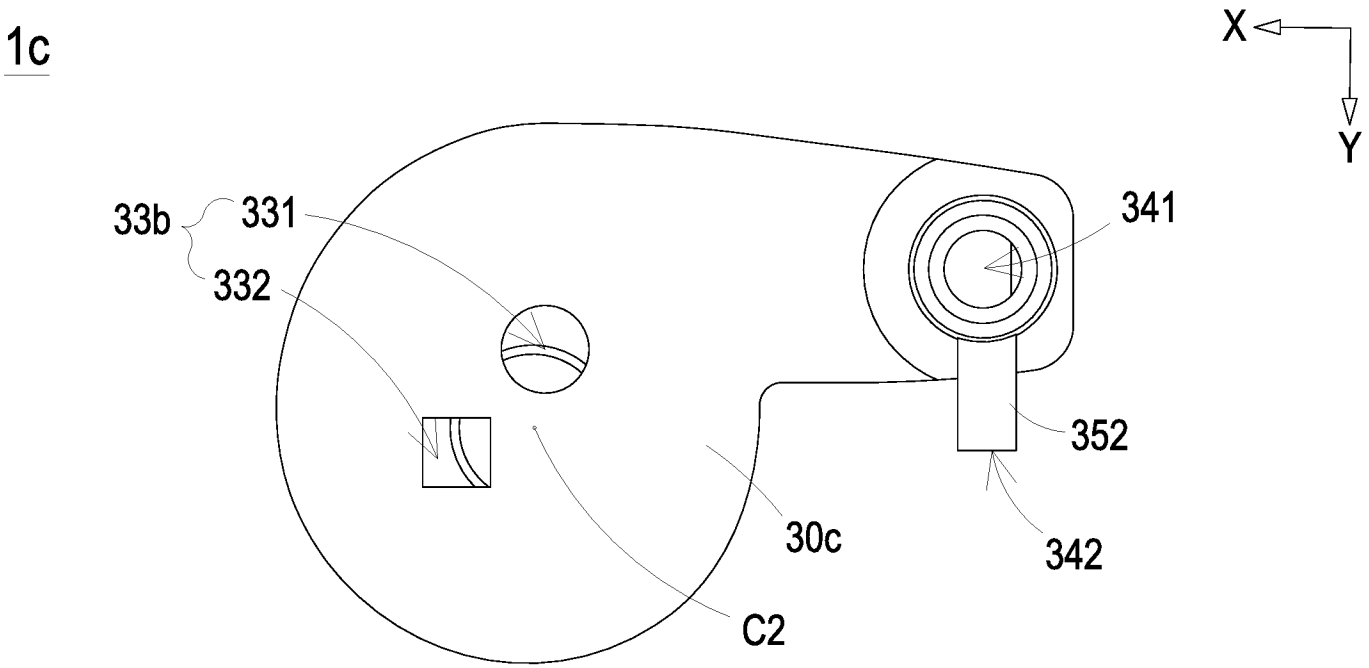
FIG. 10 is a top view illustrating a centrifugal fan according to a fourth embodiment of the present disclosure.

FIG. 10 is a top view illustrating a centrifugal fan according to a fourth embodiment of the present disclosure. In the embodiment, the structures, elements and functions of the centrifugal fan 1*c* are similar to those of the centrifugal fan 1 in FIGS. 1 to 7. The elements and features indicated by the numerals similar to those of the first embodiment mean similar elements and features, and are not redundantly described herein. In the embodiment, the flow inlet 33*b* of the first case 30*c* further includes a first opening 331 and a second opening 332 misaligned to the rotating center C2 of the impeller 10, respectively. Thus, it is more advantageous of enhancing the transportation efficiency of the centrifugal fan 1*c*. Preferably but not exclusively, the first opening 331 is circular, and the second opening 332 is quadrilateral. The present disclosure is not limited thereto.

Figure 11A:
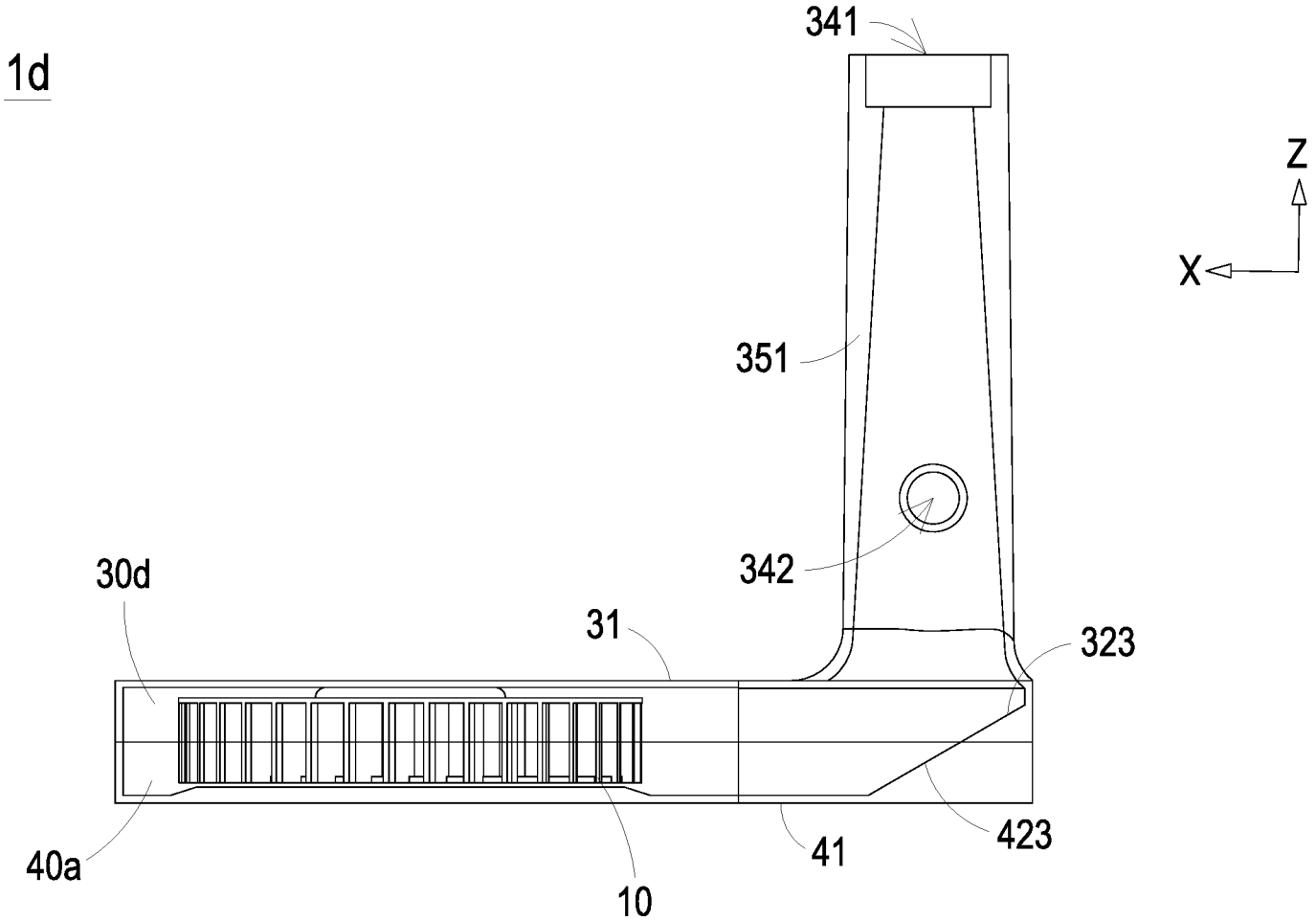
FIG. 11A is a cross-sectional view illustrating a centrifugal fan according to a fifth embodiment of the present disclosure.
Figure 11B:
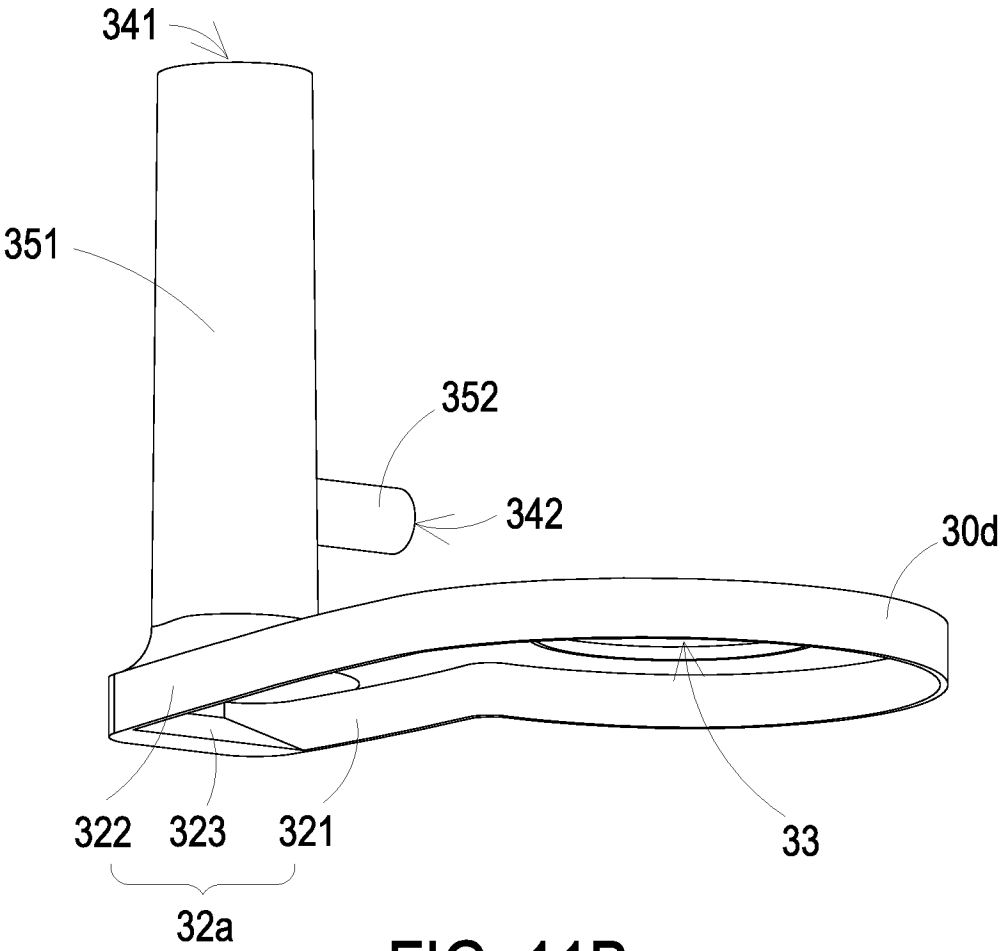
FIG. 11B is a perspective view illustrating the first case of the centrifugal fan according to the fifth embodiment of the present disclosure.
Figure 11C:
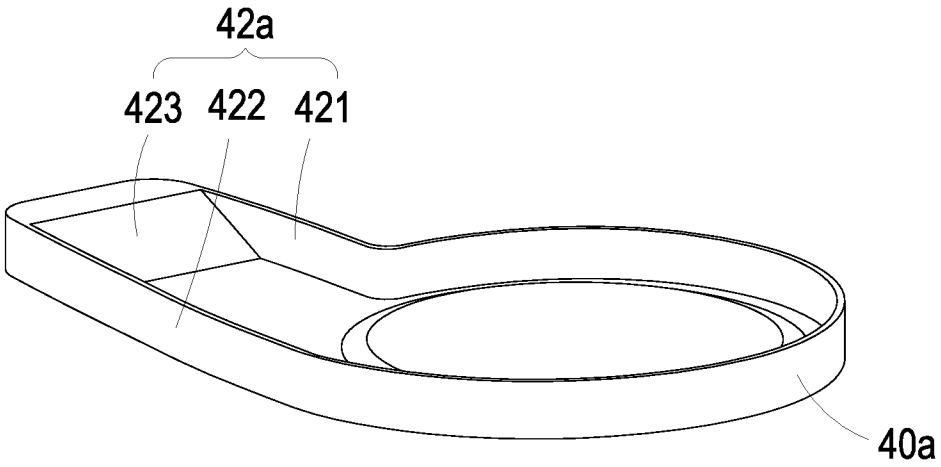
FIG. 11C is a perspective view illustrating the second case of the centrifugal fan according the fifth embodiment of the present disclosure.

FIG. 11A is a cross-sectional view illustrating a centrifugal fan according to a fifth embodiment of the present disclosure. FIG. 11B is a perspective view illustrating the first case of the centrifugal fan according to the fifth embodiment of the present disclosure. FIG. 11C is a perspective view illustrating the second case of the centrifugal fan according the fifth embodiment of the present disclosure. In the embodiment, the structures, elements and functions of the centrifugal fan 1*d* are similar to those of the centrifugal fan 1 in FIGS. 1 to 7. The elements and features indicated by the numerals similar to those of the first embodiment mean similar elements and features, and are not redundantly described herein. In the embodiment, the at least one first guiding wall 32*a* of the first case 30*d* and the at least one second guiding wall 42*a* of the second case 40*a* spatially correspond to each other. Preferably but not exclusively, the first guiding wall 32*a* further includes a guiding portion 323, which is disposed between the pair of lateral walls 321, 322 and connected between the corresponding ends of the pair of lateral walls 321, 321. The guiding portion 323 is separated away from the impeller 10. Preferably but not exclusively, the guiding portion 323 includes an inclined surface. Preferably but not exclusively, the second guiding wall 42*a* further includes a guiding portion 423, which is disposed between the pair of lateral walls 421, 422 and connected between the corresponding ends of the pair of lateral walls 421, 422. The guiding portion 423 is separated away from the impeller 10. Preferably but not exclusively, the guiding portion 423 includes an inclined surface. The guiding portion 323 of the at least one first guiding wall 32*a* and the guiding portion 423 of the at least one second guiding wall 42*a* are connected with each other to form a continuous inclined surface, as shown in FIG. 11A. In the embodiment, the flow guiding channel 51 includes the guiding portion 323 and the guiding portion 423 disposed therein to form the inclined surface. With the continuous inclined surface spatially corresponding to the first flow outlet 341, a flow guiding function is provided to reduce airflow resistance. Thus, it is beneficial to enhance the efficiency of air transportation between the flow inlet 33 and the first flow outlet 341 of the centrifugal fan 1*d*.

Figure 12A:
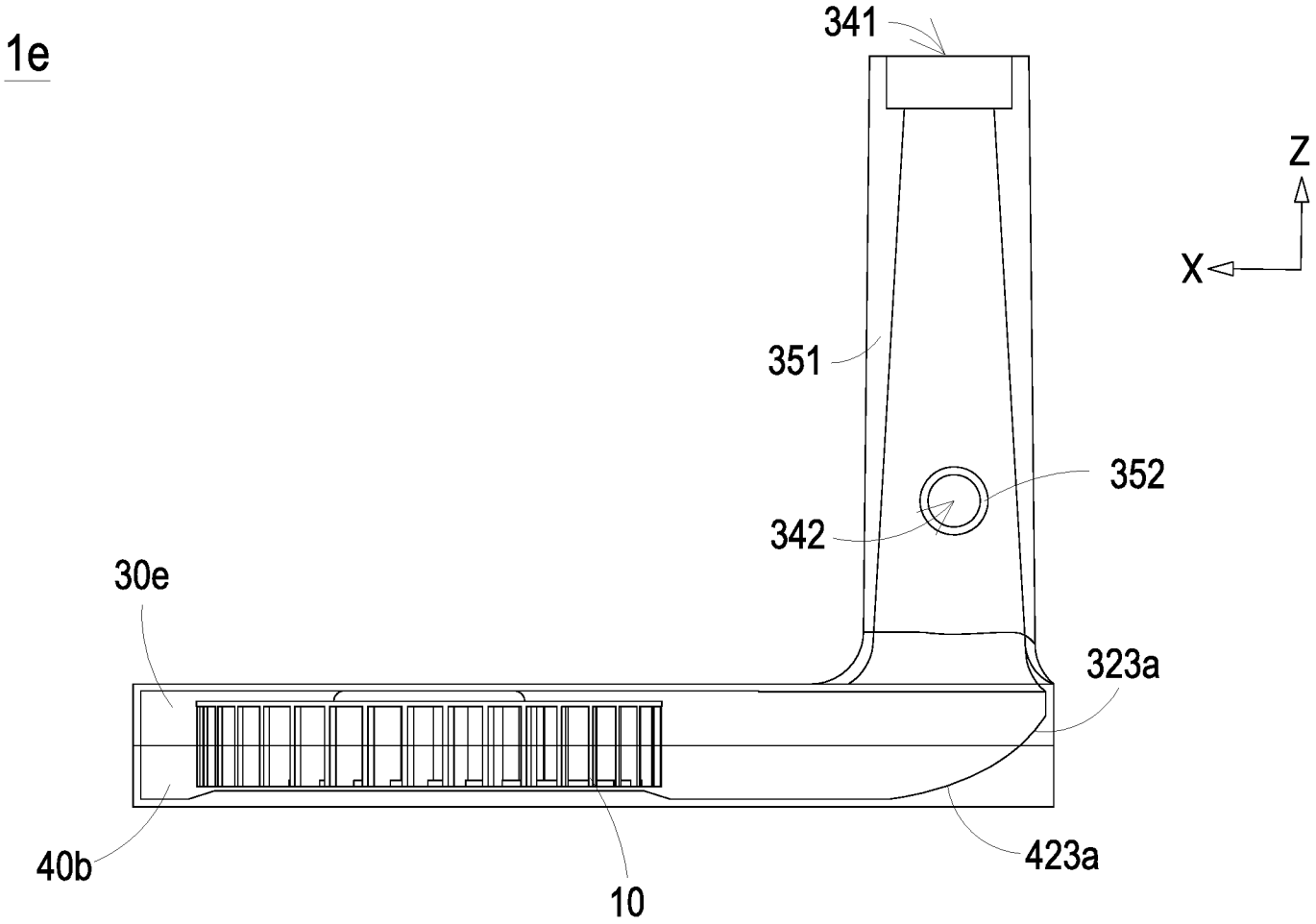
FIG. 12A is a cross-sectional view illustrating a centrifugal fan according to a sixth embodiment of the present disclosure.
Figure 12B:
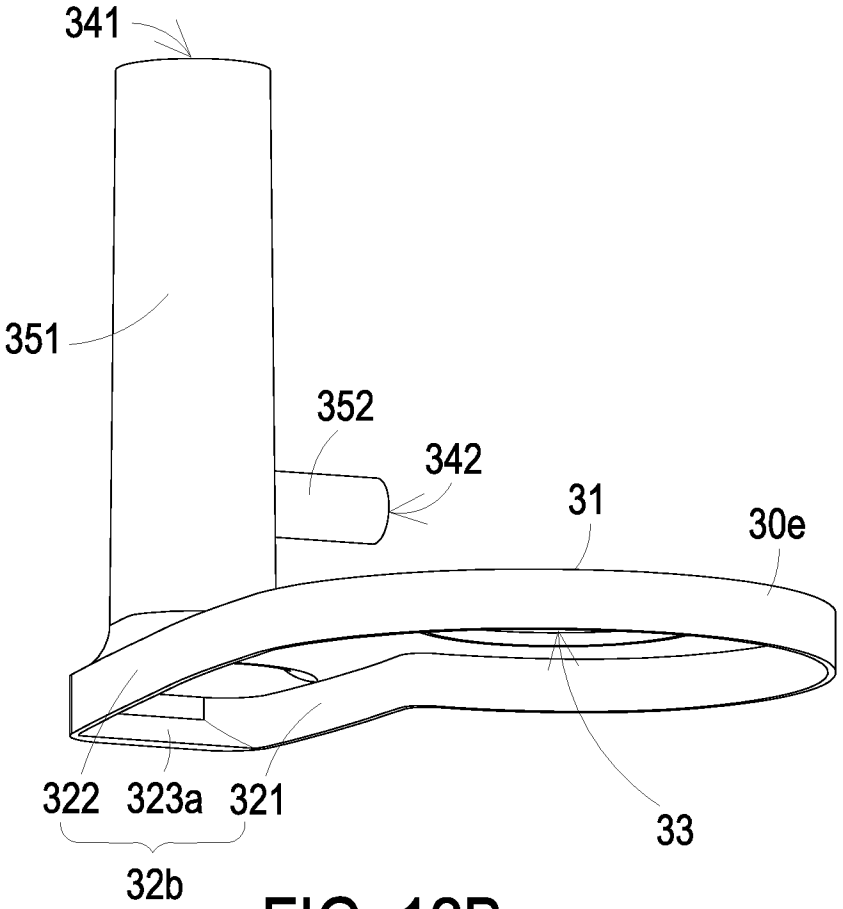
FIG. 12B is a perspective view illustrating the first case of the centrifugal fan according to the sixth embodiment of the present disclosure.
Figure 12C:
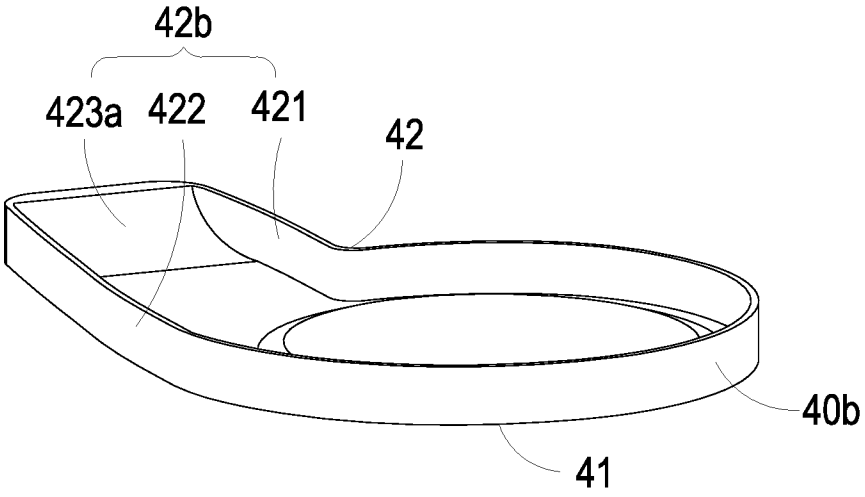
FIG. 12C is a perspective view illustrating the second case of the centrifugal fan according the sixth embodiment of the present disclosure.

FIG. 12A is a cross-sectional view illustrating a centrifugal fan according to a sixth embodiment of the present disclosure. FIG. 12B is a perspective view illustrating the first case of the centrifugal fan according to the sixth embodiment of the present disclosure. FIG. 12C is a perspective view illustrating the second case of the centrifugal fan according the sixth embodiment of the present disclosure. In the embodiment, the structures, elements and functions of the centrifugal fan 1*e* are similar to those of the centrifugal fan 1*d* in FIGS. 11A to 11C. The elements and features indicated by the numerals similar to those of the first embodiment mean similar elements and features, and are not redundantly described herein. In the embodiment, the at least one first guiding wall 32*b* of the first case 30*e* and the at least one second guiding wall 42*b* of the second case 40*b* spatially correspond to each other. Preferably but not exclusively, the first guiding wall 32*b* further includes a guiding portion 323*a*, which is a curved surface. Preferably but not exclusively, the second guiding wall 42*b* further includes a guiding portion 423*a*, which is a curved surface. The guiding portion 323*a* of the at least one first guiding wall 32*b* and the guiding portion 423*a* of the at least one second guiding wall 42*b* are connected with each other to form a continuous curved surface, as shown in FIG. 12A. With the smooth curved surface spatially corresponding to the first flow outlet 341, a flow guiding function is provided to reduce airflow resistance. Thus, it is beneficial to enhance the efficiency of air transportation between the flow inlet 33 and the first flow outlet 341 of the centrifugal fan 1*e*.

Figure 13:
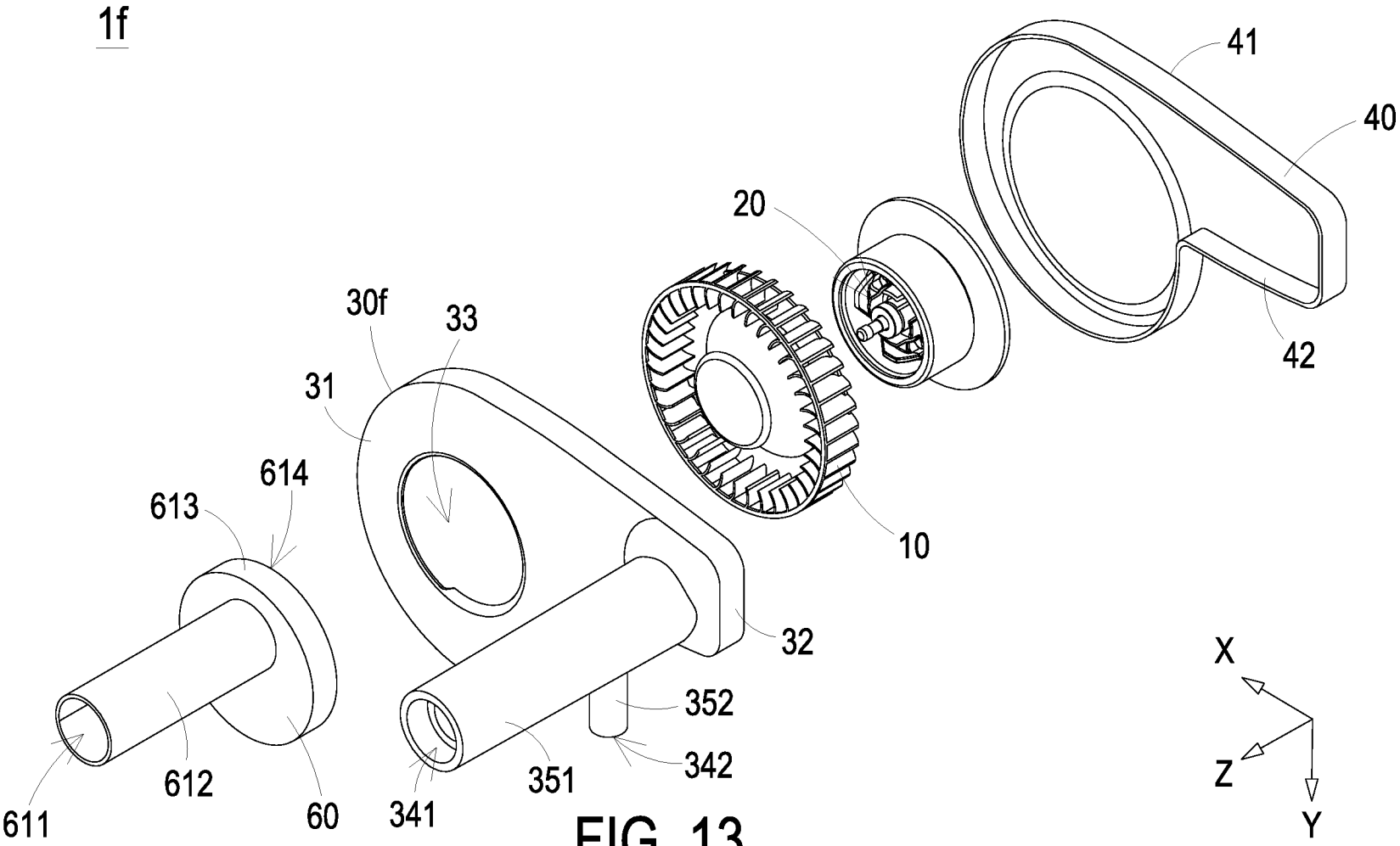
FIG. 13 is a structural exploded view illustrating a centrifugal fan according to a seventh embodiment of the present disclosure.

FIG. 13 is a structural exploded view illustrating a centrifugal fan according to a seventh embodiment of the present disclosure. In the embodiment, the structures, elements and functions of the centrifugal fan if are similar to those of the centrifugal fan 1 in FIGS. 1 to 7. The elements and features indicated by the numerals similar to those of the first embodiment mean similar elements and features, and are not redundantly described herein. In the embodiment, the centrifugal fan if further includes a pressurized assembly 60 detachably connected to the flow inlet 33 on the first side 31 of the first case 30*f*. The pressurized assembly 60 further includes a connection part 613, a connection opening 614, a pressurized flow inlet 611 and a pressurized tube 612, wherein the connection opening 614 is disposed on an end of the connection part 613, spatially corresponds to the flow inlet 33, and is matched and connected to the flow inlet 33. The pressurized tube 612 is connected to another end of the connection part 613, the pressurized flow inlet 611 spatially corresponds to the connection opening 614, and the pressurized flow inlet 611 is in fluid communication with the connection opening 614 and the flow inlet 33 through the pressurized tube 612 and the connection part 613. Preferably but not exclusively, the inner diameter of the pressurized tube 612 is less than the inner diameter of the connection part 613, and a center of the pressurized flow inlet 611 and a center of the connection opening 614 are misaligned to each other. Namely, the pressurized flow inlet 611 and the pressurized tube 612 are eccentrically disposed with respect to the connection part 613 and the connection opening 614. Thus, with the arrangement of the pressurized assembly 60, the efficiency of air transportation between the flow inlet 33 and the first flow outlet 341 of the centrifugal fan if is enhanced.

Figure 14:
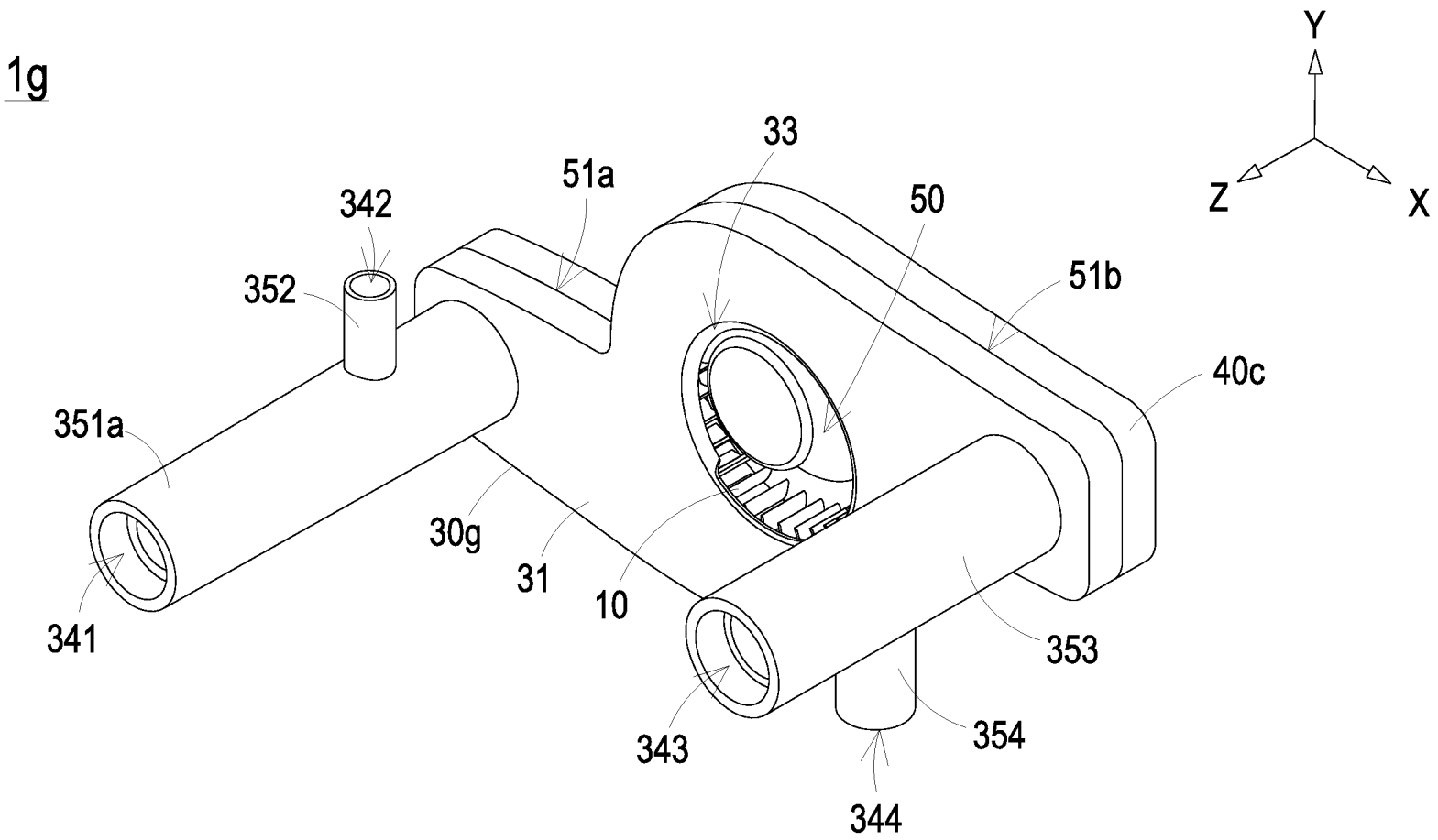
FIG. 14 is a perspective view illustrating a centrifugal fan according to an eighth embodiment of the present disclosure.
Figure 15:
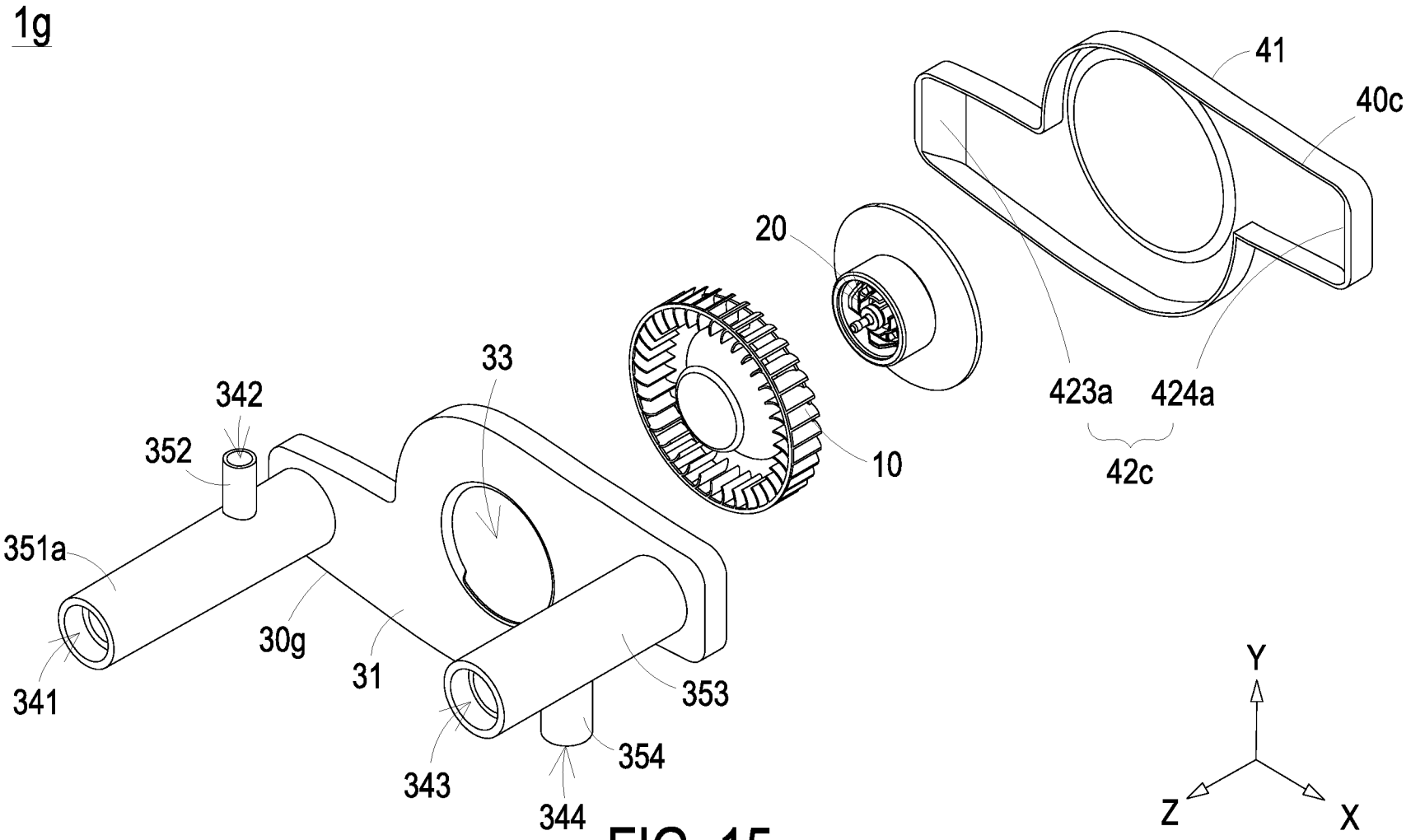
FIG. 15 is a structural exploded view illustrating the centrifugal fan according to the eighth embodiment of the present disclosure.
Figure 16:
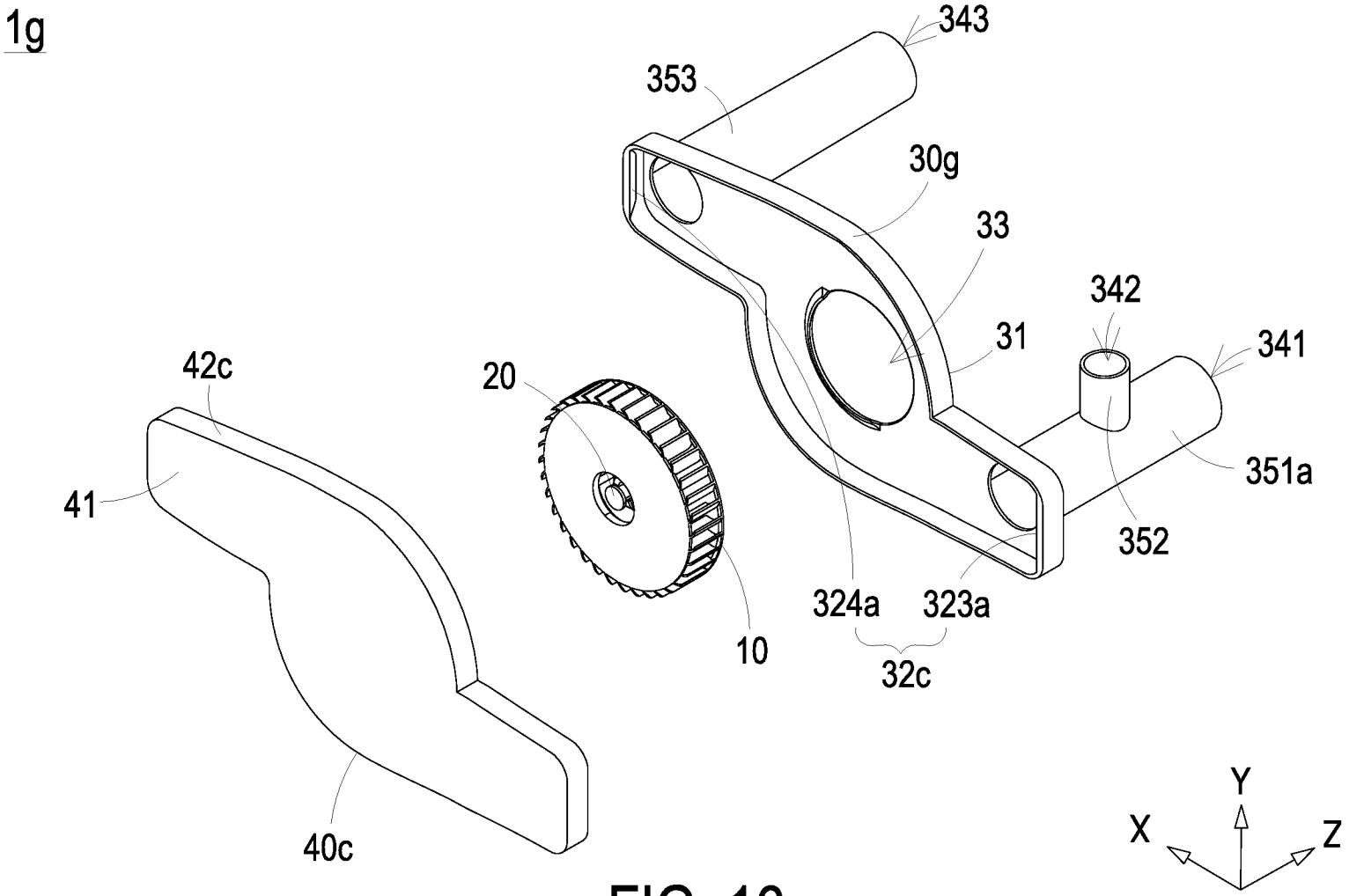
FIG. 16 is a structural exploded view illustrating the centrifugal fan according to the eighth embodiment of the present disclosure and taken at another viewing angle.
Figure 17:
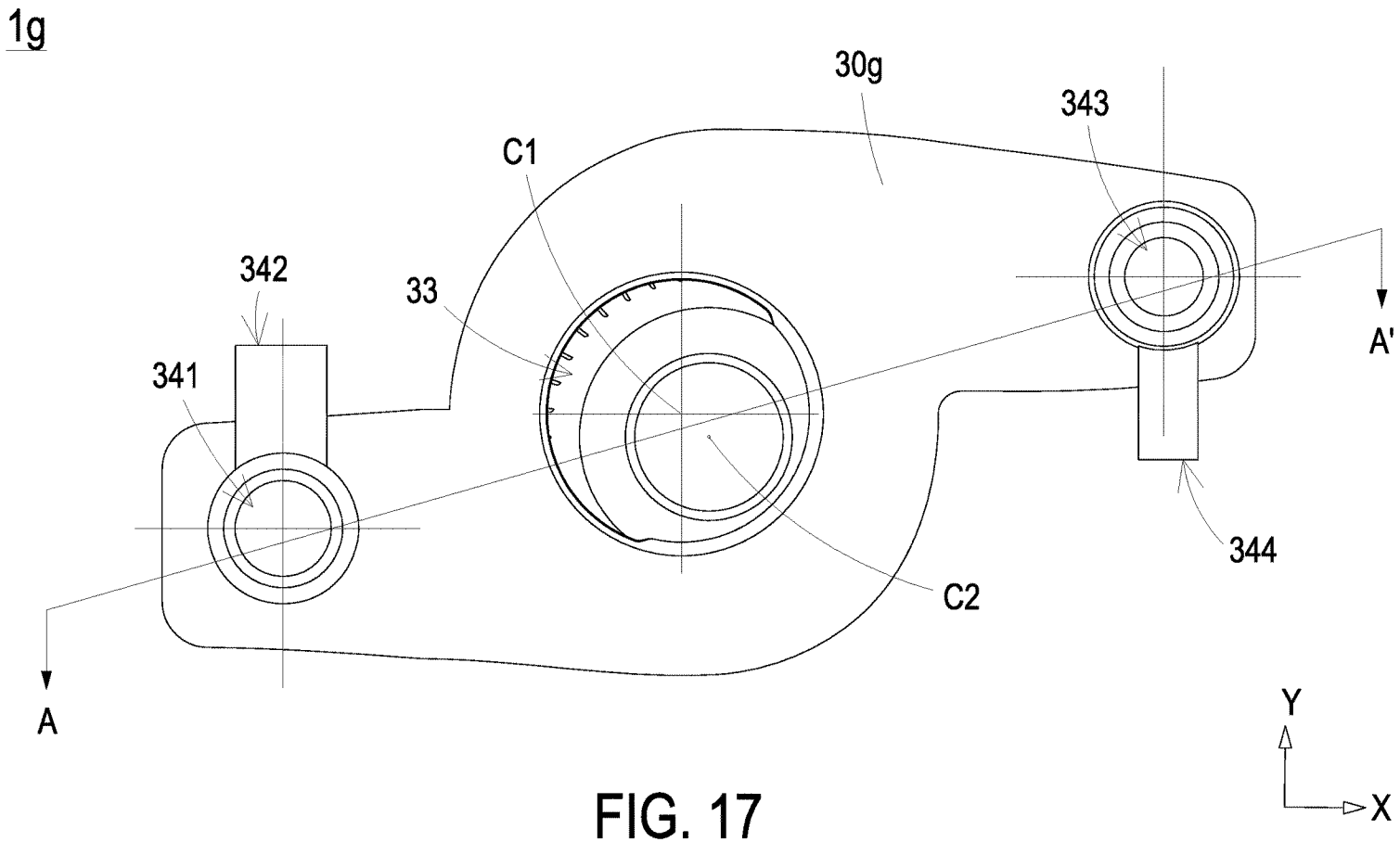
FIG. 17 is a top view illustrating the centrifugal fan according to the eighth embodiment of the present disclosure.
Figure 18:
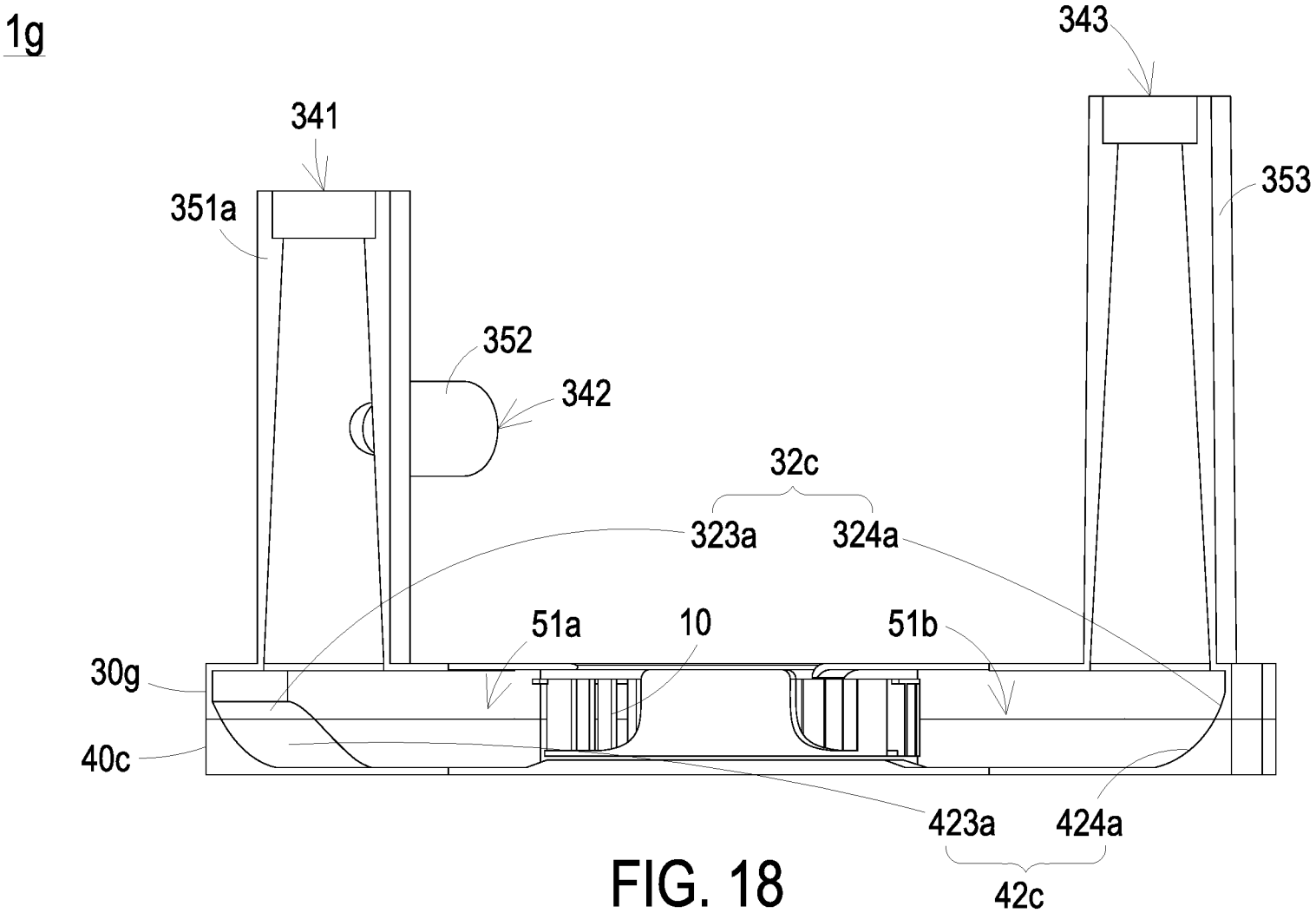
FIG. 18 is a cross-sectional view taken along the line AA' in FIG. 17.

FIG. 14 is a perspective view illustrating a centrifugal fan according to an eighth embodiment of the present disclosure. FIGS. 15 and 16 are a structural exploded view illustrating the centrifugal fan according to the eighth embodiment of the present disclosure. FIG. 17 is a top view illustrating the centrifugal fan according to the eighth embodiment of the present disclosure. FIG. 18 is a cross-sectional view taken along the line AA' in FIG. 17. In the embodiment, the structures, elements and functions of the centrifugal fan 1*g* are similar to those of the centrifugal fan 1 in FIGS. 1 to 7. The elements and features indicated by the numerals similar to those of the first embodiment mean similar elements and features, and are not redundantly described herein. In the embodiment, the centrifugal fan 1*g* includes an impeller 10, a motor 20, a first case 30*g* and a second case 40*c*. In the embodiment, the first case 30*g* includes a first side 31, at least one first guiding wall 32*c*, a flow inlet 33, a first flow outlet 341, a second flow outlet 342, a third flow outlet 343, a fourth flow outlet 344, a first guiding tube 351*a*, a second guiding tube 352, a third guiding tube 353 and a fourth guiding tube 354. The second case 40*c* includes a second side 41 and at least one second guiding wall 42*c*. The at least one second guiding wall 42*c* is connected with the second side 41. The first side 31 of the first case 30*g* and the second side 41 of the second case 40*c* are two opposite sides. The flow inlet 33 of the first case 30*g* is disposed on the first side 31, and the first flow outlet 341, the second flow outlet 342, the third flow outlet 343, the fourth flow outlet 344 and the flow inlet 33 are located at the same side of the centrifugal fan 1*g*. Namely, the first flow outlet 341, the second flow outlet 342, the third flow outlet 343, the fourth flow outlet 344 and the flow inlet 33 are located at the first side 31 of the first case 30*g* and opposite to the second side 41 of the second case 40*c*. In the embodiment, the first guiding tube 351*a* is in fluid communication between the accommodation space 50 and the first flow outlet 341. The second guiding tube 352 is in fluid communication between the first guiding tube 351*a* and the second flow outlet 342. The third guiding tube 353 is in fluid communication between the accommodation space 50 and the third flow outlet 343. The fourth guiding tube 354 is in fluid communication between the third guiding tube 353 and the fourth flow outlet 344. Furthermore, the axial line of the first guiding tube 351*a* and the first flow outlet 341, the axial line of the third guiding tube 353 and the third flow outlet 343, and the axial line of the flow inlet 33 and the impeller extend in the same direction. Preferably but not exclusively, the first guiding tube 351*a*, the second guiding tube 352, the third guiding tube 353, the fourth guiding tube 354 and the first case 30*g* are integrally formed into one piece. However, the present disclosure is not limited thereto. In the embodiment, the structures, elements and functions of the third guiding tube 353 and the fourth guiding tube 354 are similar to those of the first guiding tube 351*a* and the second guiding tube 352, and are not redundantly described herein.

Figure 19:
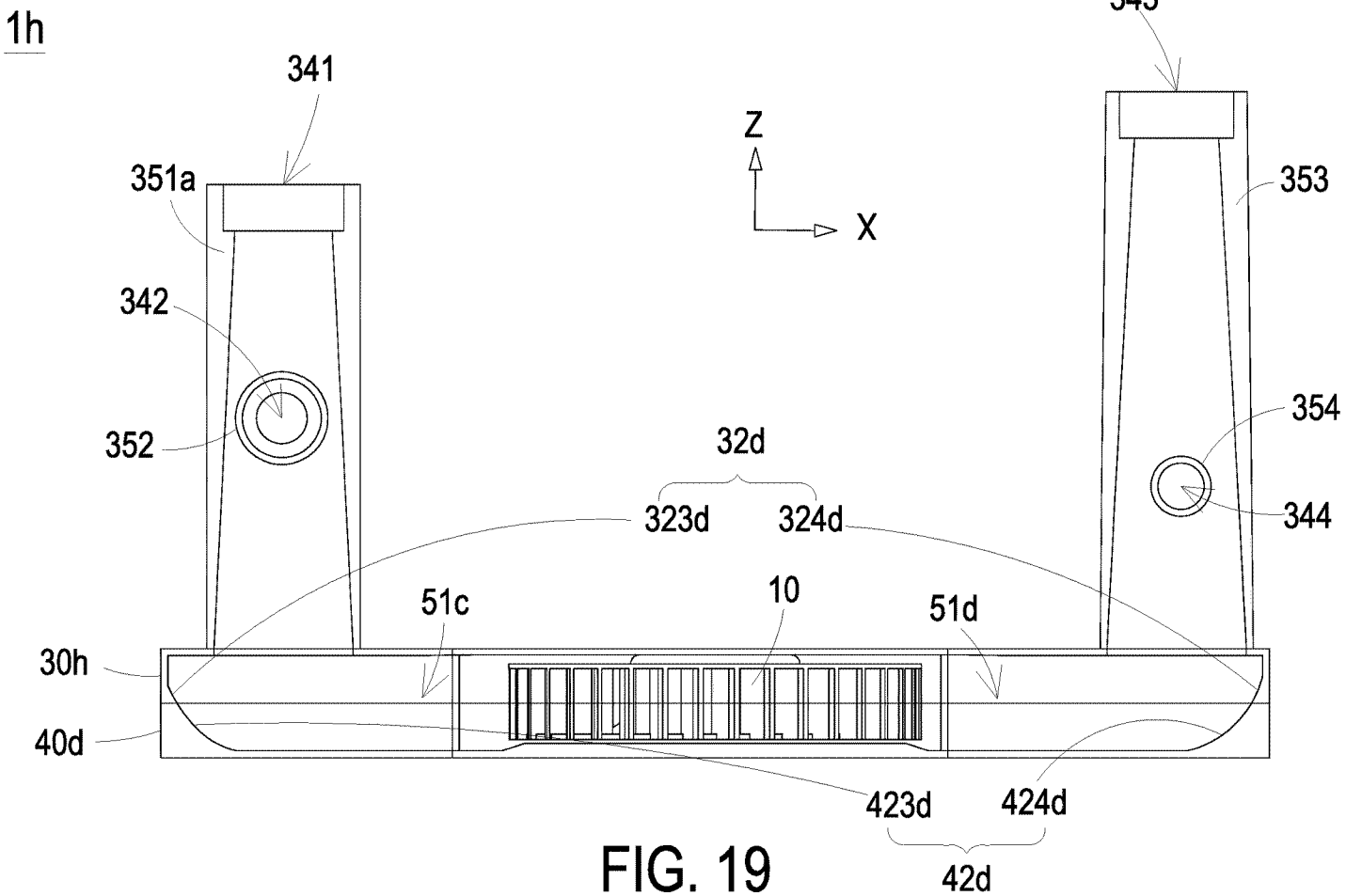
FIG. 19 is a cross-sectional view illustrating a centrifugal fan according to a ninth embodiment of the present disclosure.

Preferably but not exclusively, in the embodiment, the flow inlet 33, the first flow outlet 341, and the third flow outlet 343 face toward the Z-axis direction, which is the same direction as the axial direction of the impeller 10. The first guiding tube 351*a* in fluid communication to the first flow outlet 341 and the third guiding tube 353 in fluid communication to the third flow outlet 353 are connected to the first side 31 of the first case 30*g*, and located at two opposite lateral sides of the impeller 10, respectively, so as to provide air transportation function at two opposite lateral sides of the impeller 10. With respect to the first guiding tube 351*a* in fluid communication to the first flow outlet 341 and the third guiding tube 353 in fluid communication to the third flow outlet 343, the at least one first guiding wall 32*c* and the at least one second guiding wall 42*c* are assembled with each other to form a first flow guiding channel 51*a* and a second flow guiding channel 51*b*. Consequently, the first flow guiding channel 51*a* is in fluid communication between the accommodation space 50 and the first guiding tube 351*a*, and the second flow guiding channel 51*b* is in fluid communication between the accommodation space 50 and the third guiding tube 353. Preferably but not exclusively, the first flow guiding channel 51*a* is formed with the cross sectional areas gradually reduced, so that the efficiency of air transportation between the flow inlet 33 and the first flow outlet 341 is enhanced. Preferably but not exclusively, the second flow guiding channel 51*b* is formed with the cross sectional areas gradually reduced, so that the efficiency of air transportation between the flow inlet 33 and the third flow outlet 343 is enhanced. In an embodiment, the first flow guiding channel 51*a* and the second flow guiding channel 51*b* are located at the two opposite lateral sides of the impeller 10 and misaligned to each other, so as to provide the function of flow guiding, respectively. FIG. 19 is a cross-sectional view illustrating a centrifugal fan according to a ninth embodiment of the present disclosure. In the centrifugal fan 1*h*, with respect to the first guiding tube 351*a* in fluid communication to the first flow outlet 341 and the third guiding tube 353 in fluid communication to the third flow outlet 343, the at least one first guiding wall 32*d* of the first case 30*h* and the at least one second guiding wall 42*d* of the second case 40*d* are assembled with each other to form a first flow guiding channel 51*c* and a second flow guiding channel 51*d*, which are opposite to each other, so as to enhance the efficiency of air transportation from the flow inlet 33 to the first flow outlet 341 and the third flow outlet 343. Certainly, the present disclosure is not limited thereto.

Please refer to FIGS. 14 to 18. In the embodiment, the at least one first guiding wall 32*c* and the at least one second guiding wall 42*c* spatially correspond to each other. Preferably but not exclusively, the first guiding wall 32*c* further includes two guiding portions 323*a*, 324*a*, which spatially correspond to the first flow outlet 341 and the third flow outlet 343, respectively. Preferably but not exclusively, the second guiding wall 42*c* further includes two guiding portions 423*a*, 424*a*, which spatially correspond to the first flow outlet 341 and the third flow outlet 343, respectively. The guiding portion 323*a* of the at least one first guiding wall 32*c* and the guiding portion 423*a* of the at least one second guiding wall 42*c* are connected with each other to form a continuous curved surface, so as to enhance the efficiency of air transportation between the flow inlet 33 and the first flow outlet 341. The guiding portion 324*a* of the at least one first guiding wall 32*c* and the guiding portion 424*a* of the at least one second guiding wall 42*c* are connected with each other to form a continuous curved surface, so as to enhance the efficiency of air transportation between the flow inlet 33 and the third flow outlet 343. On the other hand, in the centrifugal fan 1*h* of FIG. 19, the guiding portion 323*b* of the at least one first guiding wall 32*d* and the guiding portion 423*b* of the at least one second guiding wall 42*d* are connected with each other to form a continuous curved surface, and the guiding portion 324*b* of the at least one first guiding wall 32*d* and the guiding portion 424*b* of the at least one second guiding wall 42*d* are connected with each other to form a continuous curved surface. Two continuous curved surfaces are opposite to each other in the X-axis direction. Certainly, the present disclosure is not limited thereto, and not redundantly described herein.

Moreover, in the embodiment, the second guiding tube 352 is vertically connected to the lateral wall of the first guiding tube 351*a*, and the fourth guiding tube 354 is vertically connected to the lateral wall of the third guiding tube 353. Preferably but not exclusively, the second guiding tube 352 and the fourth guiding tube 354 are extended toward two opposite directions, respectively. Preferably but not exclusively, the second flow outlet 342 and the fourth flow outlet 344 face toward two opposite directions, respectively, so as to achieve an effect of stabilizing the air transportation. The present disclosure is not limited thereto.

Figure 20:
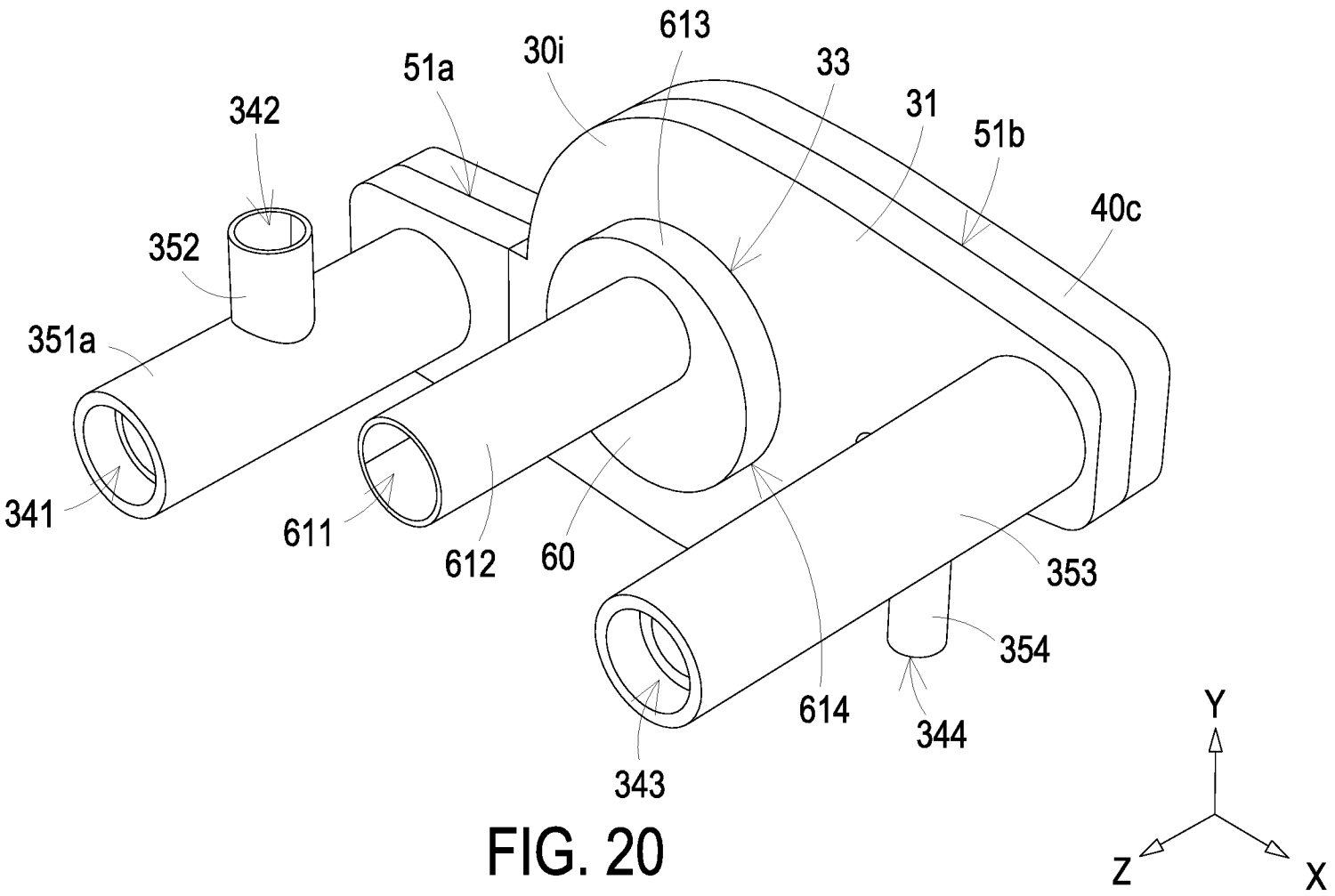
FIG. 20 is a perspective view illustrating a centrifugal fan according to a tenth embodiment of the present disclosure.

FIG. 20 is a perspective view illustrating a centrifugal fan according to a tenth embodiment of the present disclosure. In the embodiment, the structures, elements and functions of the centrifugal fan 1*i* are similar to those of the centrifugal fan 1*g* in FIGS. 14 to 18. The elements and features indicated by the numerals similar to those of the eighth embodiment mean similar elements and features, and are not redundantly described herein. In the embodiment, the centrifugal fan 1*i* further includes a pressurized assembly 60 detachably connected to the flow inlet 33 disposed on the first side 31 of the first case 30*i*. With the arrangement of the pressurized assembly 60, the efficiency of air transportation between the flow inlet 33 and the first flow outlet 341 of the centrifugal fan 1*i* is enhanced.

Figure 21:
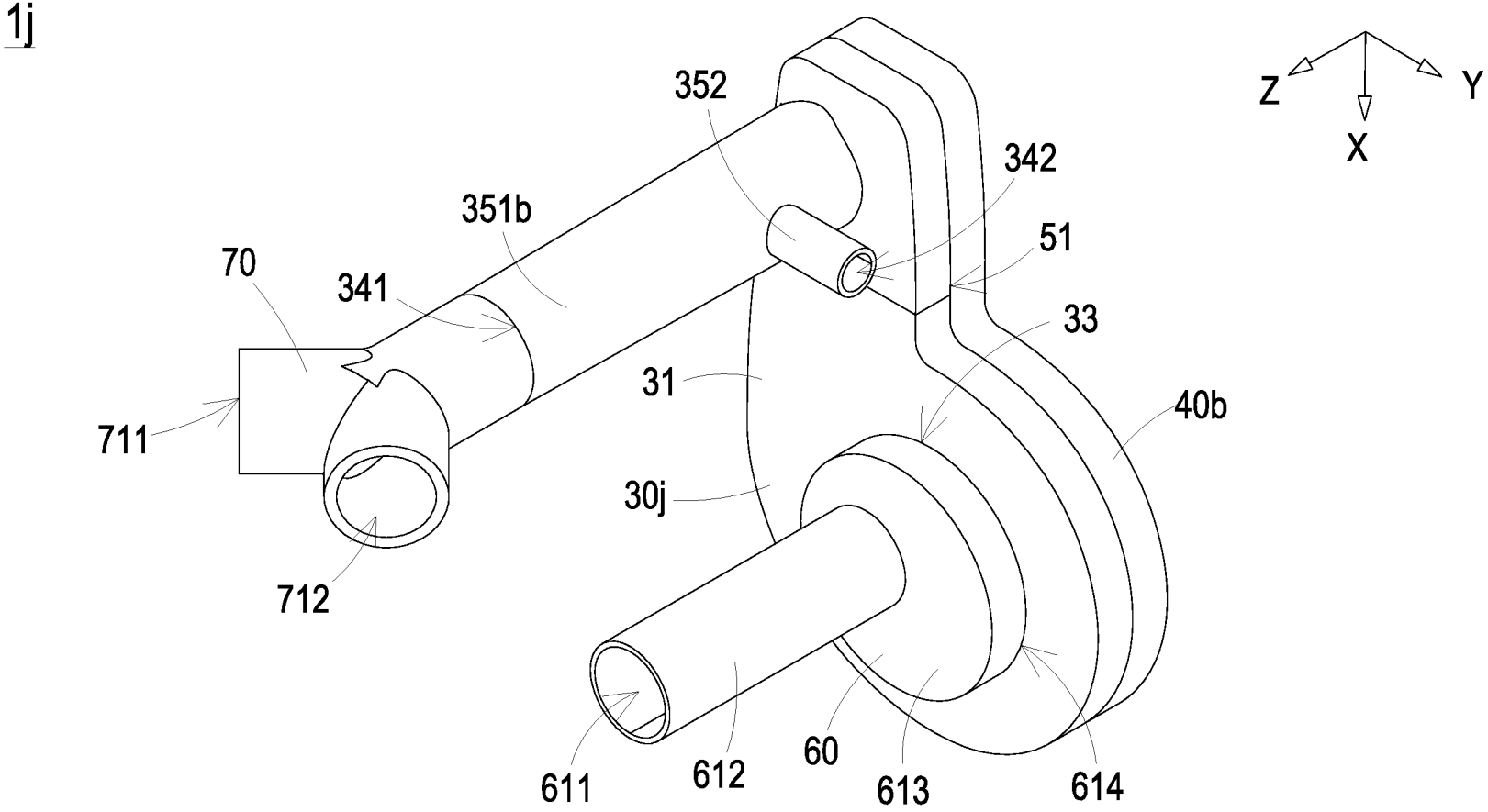
FIG. 21 is a perspective view illustrating a centrifugal fan according to an eleventh embodiment of the present disclosure.
Figure 22:
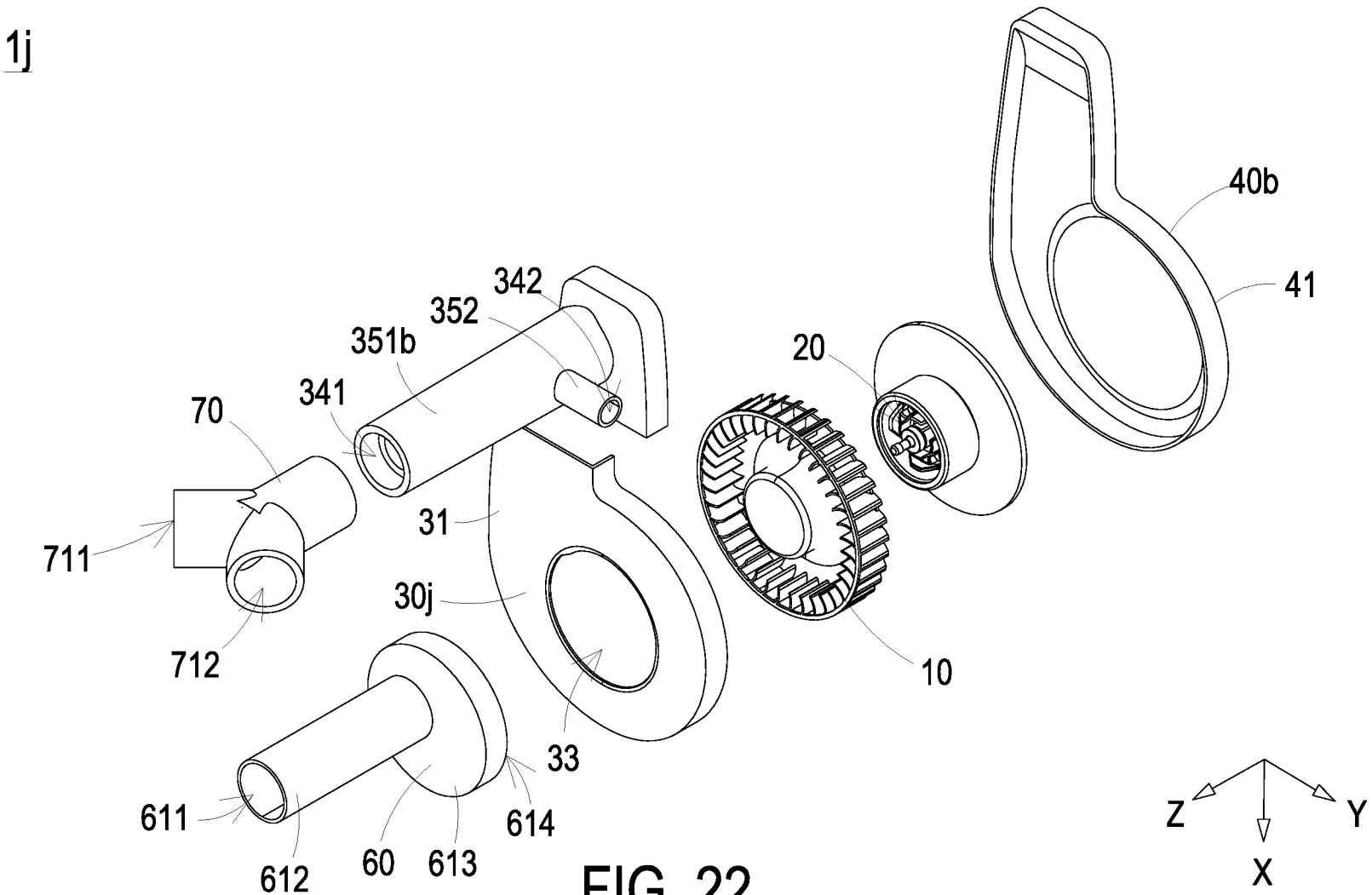
FIG. 22 is a structural exploded view illustrating the centrifugal fan according to the eleventh embodiment of the present disclosure.
Figure 23:
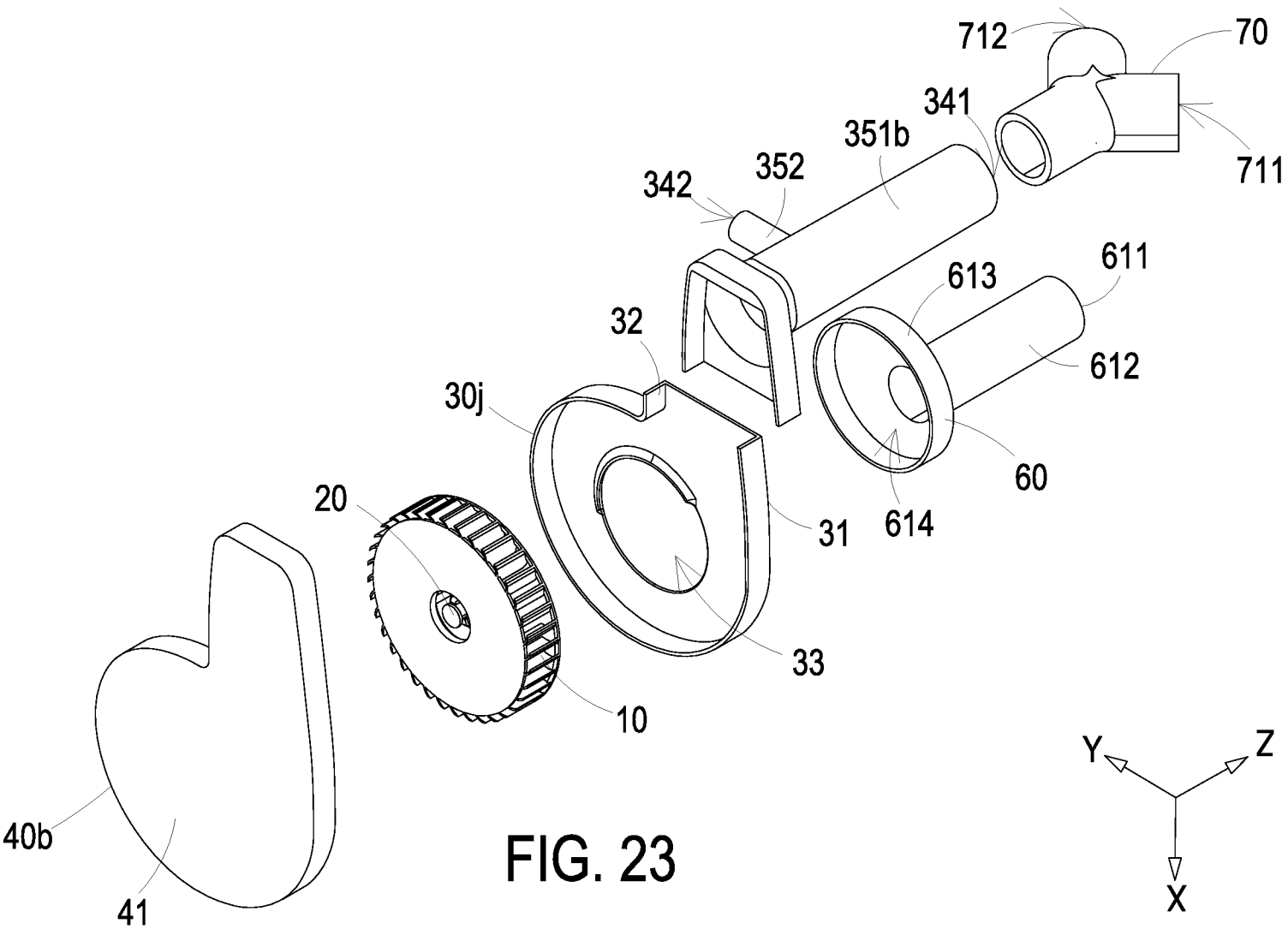
FIG. 23 is a structural exploded view illustrating the centrifugal fan according to the eleventh embodiment of the present disclosure and taken at another viewing angle.

FIG. 21 is a perspective view illustrating a centrifugal fan according to an eleventh embodiment of the present disclosure. FIGS. 22 and 23 are a structural exploded view illustrating the centrifugal fan according to the eleventh embodiment of the present disclosure. In the embodiment, the structures, elements and functions of the centrifugal fan 1*j* are similar to those of the centrifugal fan 1*e* in FIGS. 12A to 12C. The elements and features indicated by the numerals similar to those of the seventh embodiment mean similar elements and features, and are not redundantly described herein. In the embodiment, the centrifugal fan 1*j* not only includes the pressurized assembly 60, but also includes a branch tube 70 detachably connected to the first flow outlet 341 on the first guiding tube 351*b*. The branch tube 70 includes a first branch flow outlet 711 and a second branch flow outlet 712 in fluid communication with the first flow outlet 341, respectively. Since the branch tube 70 is detachably connected to the first guiding tube 351*b*, the branch tube 70 can be selectively disposed on the centrifugal fan 1*j* according to the practical requirements. The present disclosure is not limited thereto. On the other hand, in the embodiment, the first guiding tube 351*b* is detachably connected to the first case 30*j*, so as to facilitate the repair or replacement. Certainly, the present disclosure is not limited thereto.

Figure 24:
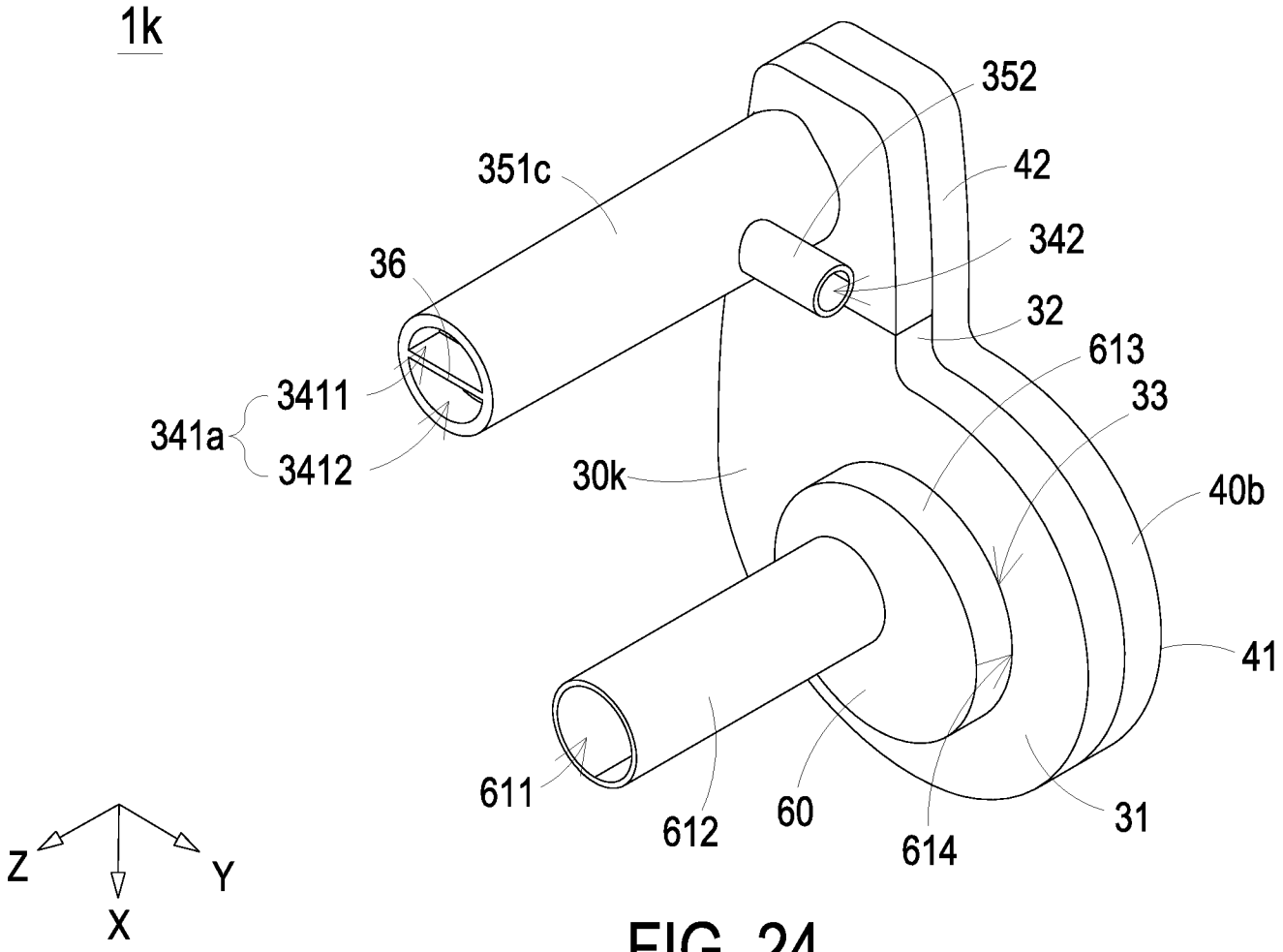
FIG. 24 is a perspective view illustrating a centrifugal fan according to a twelfth embodiment of the present disclosure.
Figure 25:
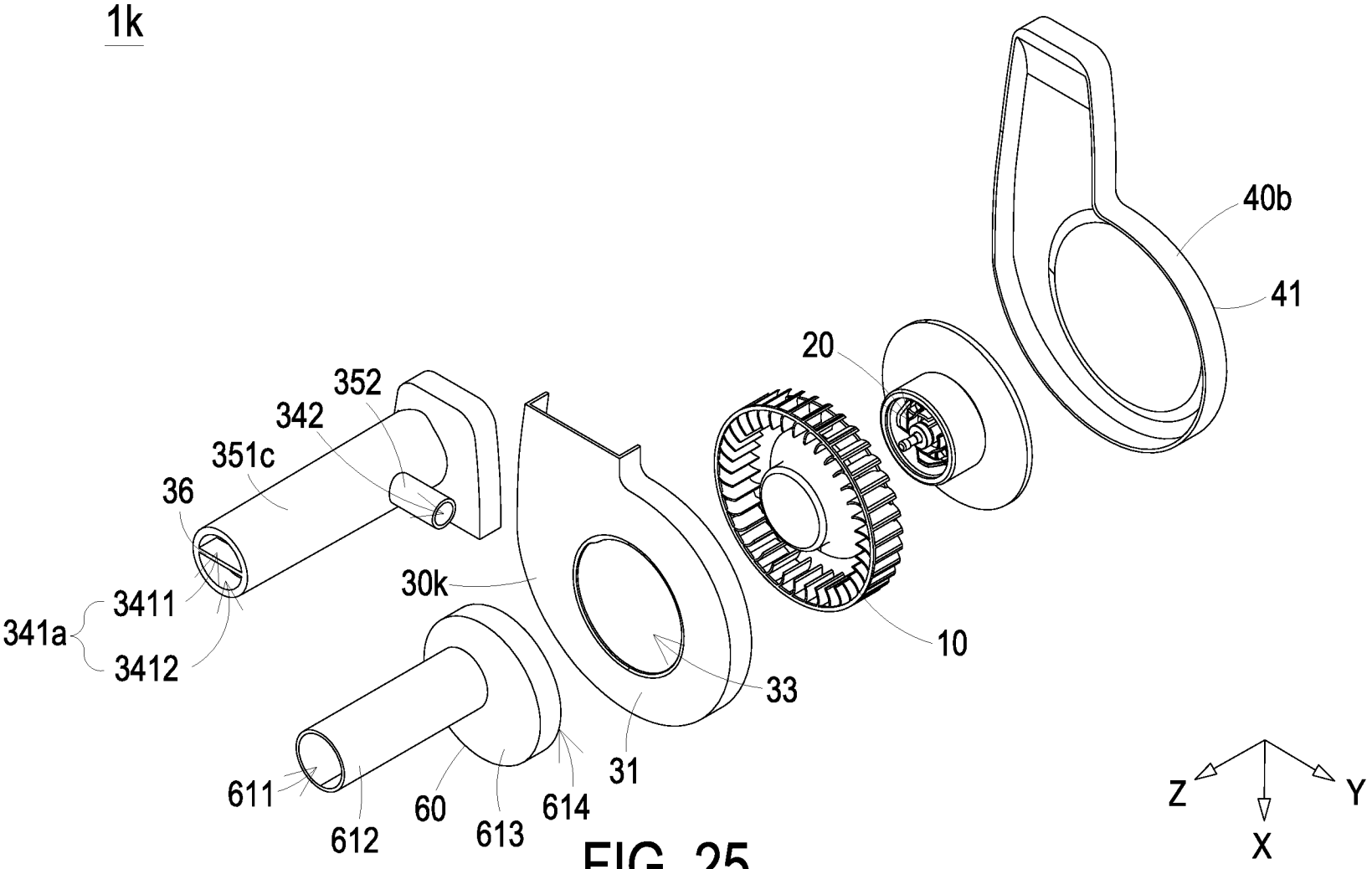
FIG. 25 is a structural exploded view illustrating the centrifugal fan according to the twelfth embodiment of the present disclosure.
Figure 26:
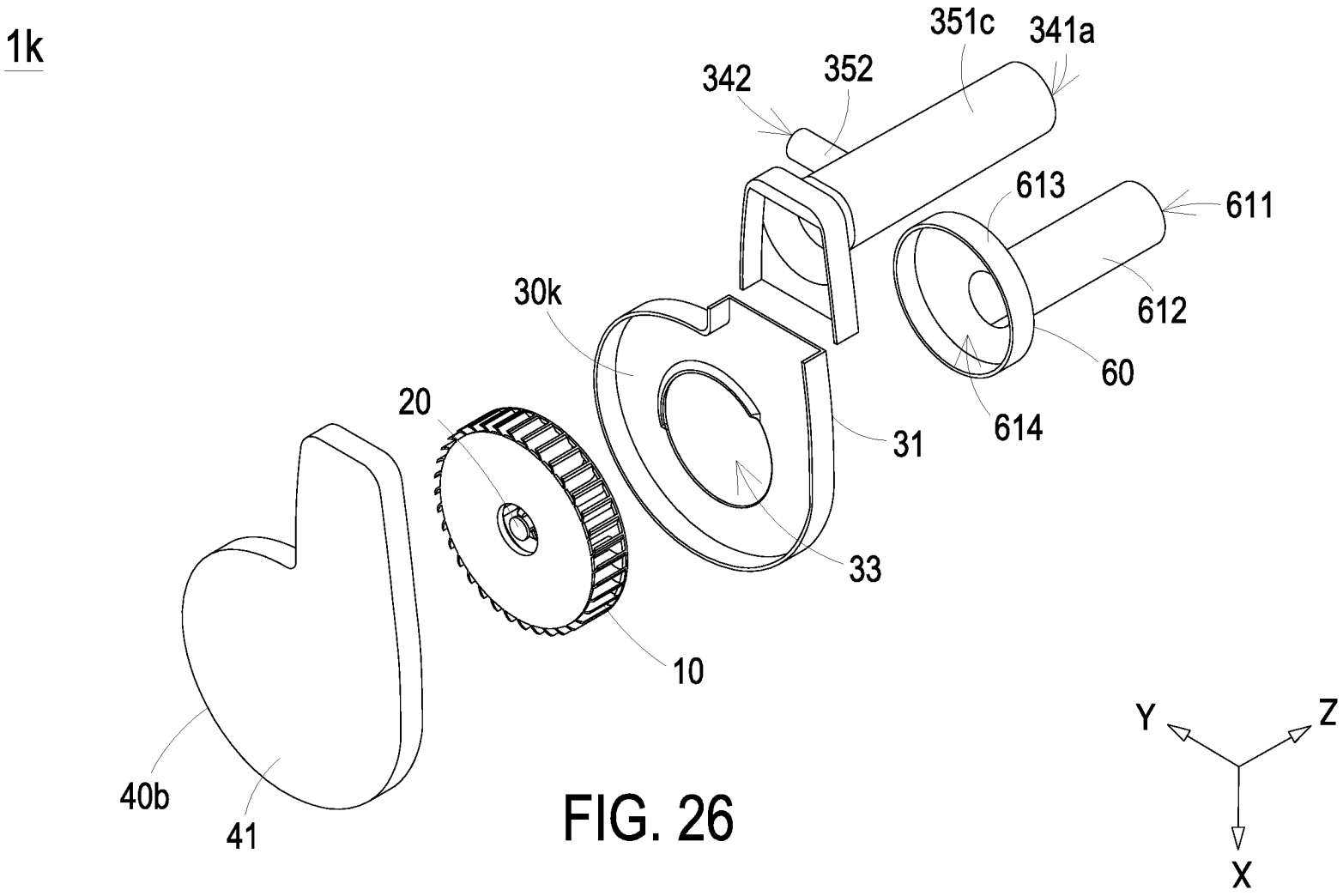
FIG. 26 is a structural exploded view illustrating the centrifugal fan according to the twelfth embodiment of the present disclosure and taken at another viewing angle.

FIG. 24 is a perspective view illustrating a centrifugal fan according to a twelfth embodiment of the present disclosure. FIGS. 25 and 26 are a structural exploded view illustrating the centrifugal fan according to the twelfth embodiment of the present disclosure. In the embodiment, the structures, elements and functions of the centrifugal fan 1*k* are similar to those of the centrifugal fan 1*f* in FIG. 13. The elements and features indicated by the numerals similar to those of the seventh embodiment mean similar elements and features, and are not redundantly described herein. In the embodiment, the centrifugal fan 1*k* further includes a partition plate 36, for example disposed within the first flow outlet 341*a* to form a first sub-outlet 3411 and a second sub-outlet 3412 in fluid communication with the accommodation space 50 (referring to FIG. 1), respectively, so as to achieve the effect of stabilizing the airflow of the first flow outlet 341*a*. On the other hand, the first guiding tube 351*c* is detachably connected to the first case 30*k*, so as to facilitate the repair or replacement. For example, the first guiding tube 351*c* of the centrifugal fan 1*k* can be replaced by the first guiding tube 351*b* of the centrifugal fan 1*j* or added the branch tube 70 of the centrifugal fan 1*j* in the foregoing embodiments. Certainly, the present disclosure is not limited thereto.

Figure 27:
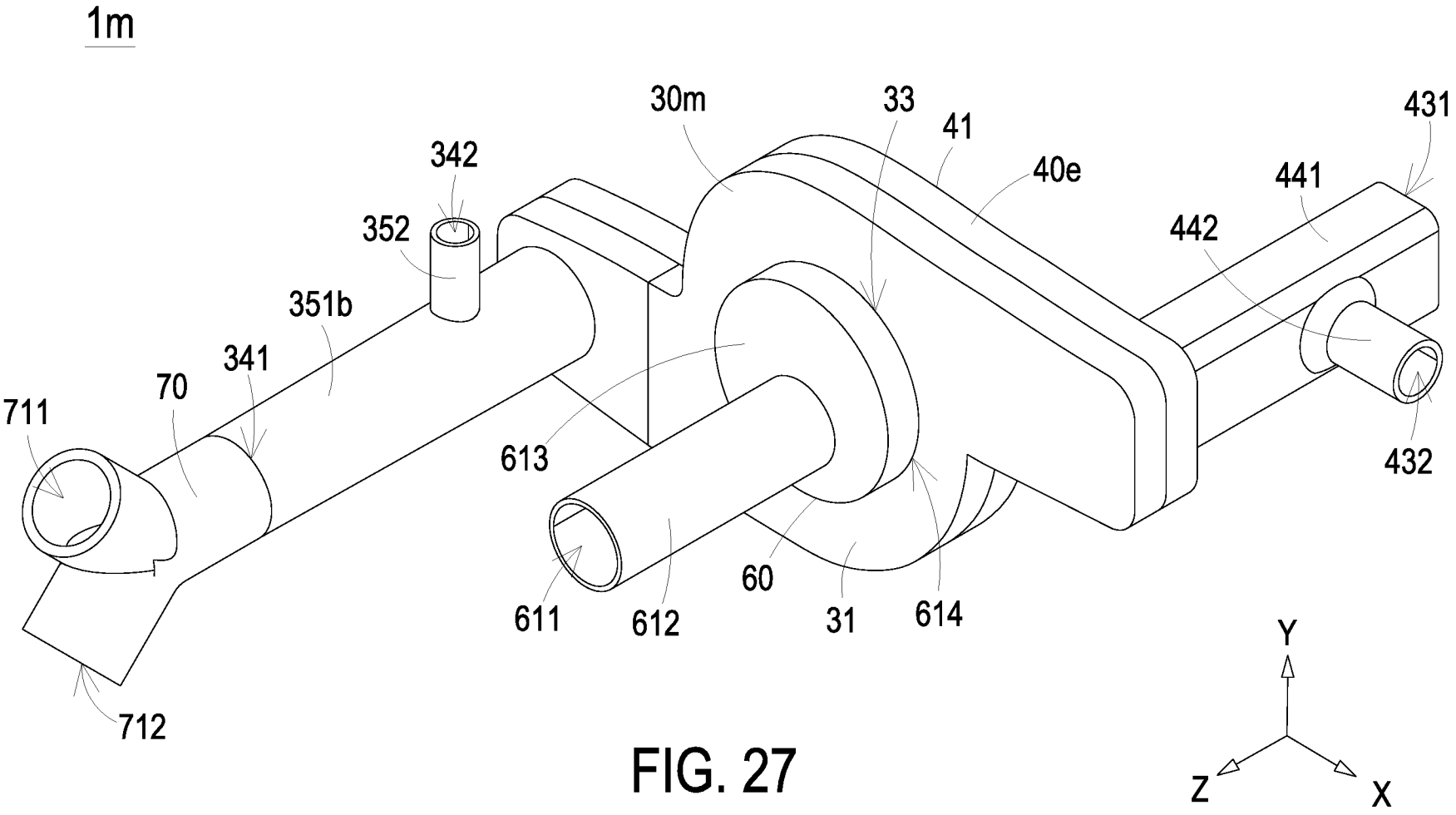
FIG. 27 is a perspective view illustrating a centrifugal fan according to a thirteenth embodiment of the present disclosure.
Figure 28:
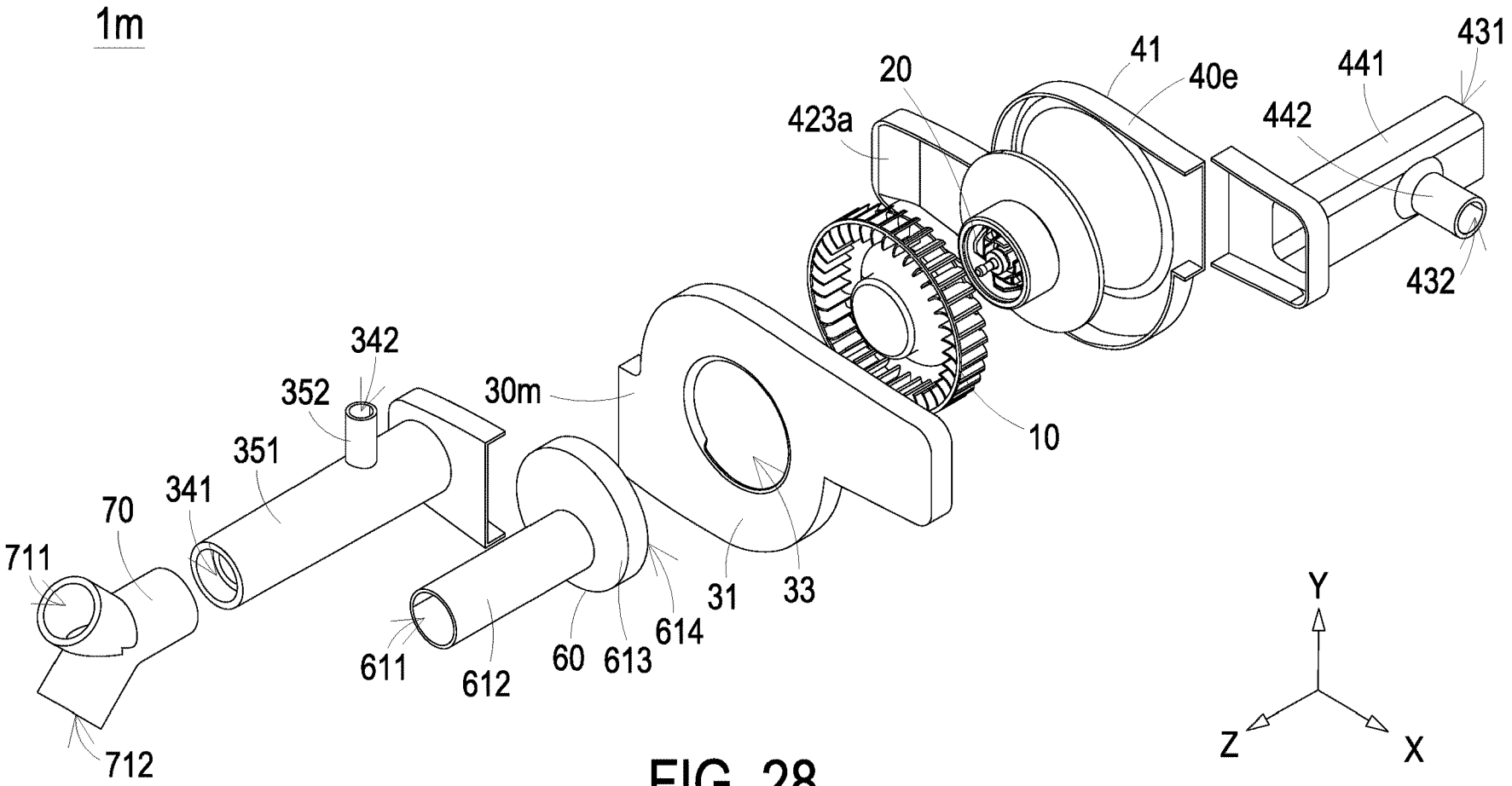
FIG. 28 is a structural exploded view illustrating the centrifugal fan according to the thirteenth embodiment of the present disclosure.
Figure 29:
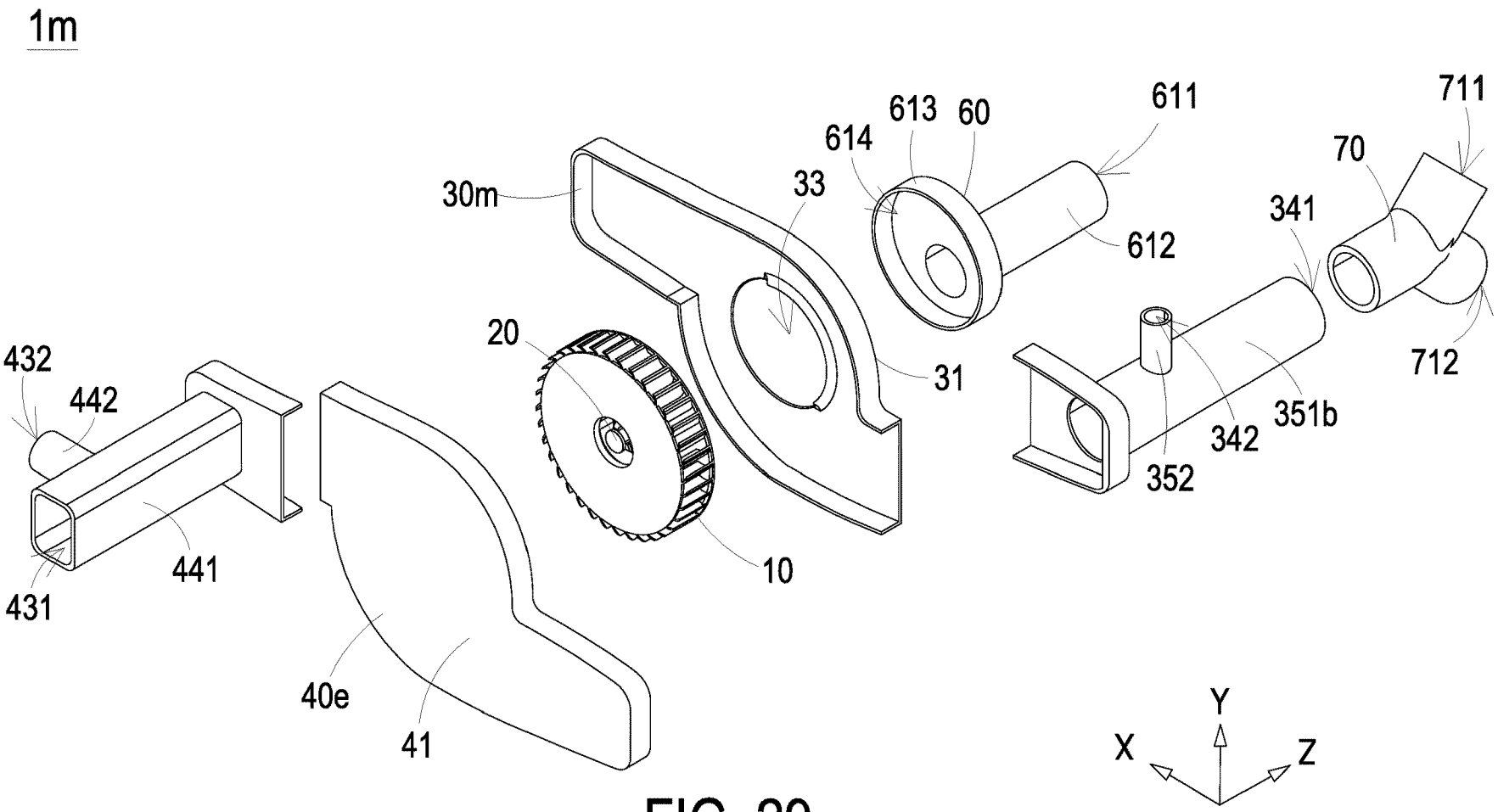
FIG. 29 is a structural exploded view illustrating the centrifugal fan according to the thirteenth embodiment of the present disclosure and taken at another viewing angle.

FIG. 27 is a perspective view illustrating a centrifugal fan according to a thirteenth embodiment of the present disclosure. FIGS. 28 and 29 are a structural exploded view illustrating the centrifugal fan according to the thirteenth embodiment of the present disclosure. In the embodiment, the structures, elements and functions of the centrifugal fan 1*m* are similar to those of the centrifugal fan 1*j* in FIGS. 21 to 23. The elements and features indicated by the numerals similar to those of the twelfth embodiment mean similar elements and features, and are not redundantly described herein. In the embodiment, the second case 40*e* of the centrifugal fan 1*m* further includes a fifth guiding tube 441, a sixth guiding tube 442, a fifth flow outlet 431 and a sixth flow outlet 432. The fifth guiding tube 441 is detachably connected to the second side 41 of the second case 40*e*. The fifth flow outlet 431 is formed on an end of the fifth guiding tube 441. The sixth flow outlet 432 is formed on an end of the sixth guiding tube 442. In the embodiment, the fifth flow outlet 431 of the second case 40*e* and the first flow outlet 341 of the first case 30*m* are misaligned to each other. Thus, the centrifugal fan 1*m* provides different variations for air transportation, and the practicality of the centrifugal fan 1*m* is increased. In an embodiment, preferably but not exclusively, the fifth guiding tube 441 is a square tube. However, the present disclosure is not limited thereto and not redundantly described herein.

In summary, the present disclosure provides a centrifugal fan. By disposing a flow inlet and a flow outlet on a same side of the centrifugal fan, when the centrifugal fan is installed in a limited space, such as in a vehicle, it is beneficial to reduce the installation space required for the centrifugal fan. At the same time, the efficiency of air transportation of the centrifugal fan is not influenced due to the limited installation space. In addition, when the centrifugal fan is combined with an external device, for example a PM2.5 particle detecting device to monitor the air quality inside the vehicle, the external device has advantages of monitoring the air quality located at the flow inlet and the flow outlet and obtaining the difference therebetween. The guiding channel of the centrifugal fan has cross-sectional areas with different sizes, which is beneficial to enhance the efficiency of air transportation between the flow inlet and the flow outlet. The cross-sectional areas in the direction of airflow in the centrifugal fan are gradually reduced, it is beneficial to increase the pressure of the airflow and increase the flow rate. Furthermore, with the arrangement of misaligning the rotating center of the impeller and the flow inlet, it is more advantageous of enhancing the transportation efficiency of the centrifugal fan. The fan case and the guiding tube are integrally formed or detachably connected to each other according to practical requirements. Moreover, a pressurized assembly and a branch tube are selectively combined with the flow inlet and the flow outlet to increase the practicality of the centrifugal fan, so that the market competitiveness of the centrifugal fan is enhanced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A centrifugal fan comprising:

an impeller;

a motor connected with the impeller and configured to drive the impeller to rotate; and a first case and a second case, wherein the first case comprises a first side, a first guiding wall, a flow inlet and a flow outlet, and the second case comprises a second side and a second guiding wall, wherein the first side and the second side are opposite to each other, and assembled with each other through the first guiding wall and the second guiding wall to form an accommodation space and a flow guiding channel, wherein the first guiding wall and the second guiding wall spatially correspond to each other and respectively include a guiding portion configured together to form the guiding channel, wherein the flow outlet and the flow inlet are located at a same side of the centrifugal fan, the flow inlet, the flow outlet and the impeller have axial lines extending in a same direction, the impeller and the motor are accommodated within the accommodation space, and the flow guiding channel is in fluid communication between the accommodation space and the flow outlet;

wherein a rotating center of the impeller and a center of the flow inlet are misaligned to each other, and the flow guiding channel is gradually shrunk along a direction from the accommodation space to the flow outlet.

2. The centrifugal fan according to claim 1, wherein the flow inlet is non-circular.

3. The centrifugal fan according to claim 1, further comprising a partition plate disposed within the flow outlet to form a first sub-outlet and a second sub-outlet.

4. A centrifugal fan comprising:

an impeller;

a motor connected with the impeller and configured to drive the impeller to rotate; and a first case and a second case assembled with each other to form an accommodation space, wherein the impeller and the motor are accommodated within the accommodation space, wherein the first case comprises a first side, a first guiding wall, a flow inlet and a flow outlet, the flow inlet is disposed on the first side, and the first guiding wall is connected with the first side, wherein the second case comprises a second side and a second guiding wall, and the second guiding wall is connected with the second side, wherein the first guiding wall and the second guiding wall are assembled with each other to form a flow guiding channel, the flow guiding channel is in fluid communication between the accommodation space and the flow outlet, and the flow guiding channel has cross-sectional areas with different sizes, wherein the flow outlet and the flow inlet are located at a same side of the centrifugal fan, and the flow inlet, the flow outlet and the impeller have axial lines extending in a same direction;

wherein a rotating center of the impeller and a center of the flow inlet are misaligned to each other, and the flow guiding channel is gradually shrunk along a direction from the accommodation space to the flow outlet.

5. The centrifugal fan according to claim 4, wherein the flow guiding channel includes a guiding portion disposed therein.

6. The centrifugal fan according to claim 4, wherein the first guiding wall and the second guiding wall spatially correspond to each other and comprise a guiding portion, respectively, wherein the guiding portion of the first guiding wall and the guiding portion of the second guiding wall are connected with each other to form one of an inclined surface and a curved surface.

7. The centrifugal fan according to claim 4, wherein the first guiding wall and the second guiding wall spatially correspond to each other and comprise a pair of lateral walls, respectively, wherein the pair of lateral walls are opposite to each other, and gradually close to each other along a direction from the impeller to the flow outlet.

8. A centrifugal fan comprising:

an impeller;

a motor connected with the impeller and configured to drive the impeller to rotate; and a first case and a second case assembled with each other to form an accommodation space, wherein the impeller and the motor are accommodated within the accommodation space, wherein the first case comprises a first side, at least one first guiding wall, a flow inlet, at least one flow outlet and at least one guiding tube, the flow inlet is disposed on the first side, the at least one first guiding wall is extended from the first side, the at least one guiding tube is extended from the first side along a same direction where axial lines of the flow inlet and the impeller extend therein, and the at least one flow outlet is formed on an end of the at least one guiding tube, wherein the second case comprises a second side and at least one second guiding wall, and the at least one second guiding wall is connected with the second side, wherein the at least one first guiding wall and the at least one second guiding wall are assembled with each other to form at least one flow guiding channel, wherein the flow inlet and the at least one flow outlet are in fluid communication with each other through the accommodation space, the flow guiding channel and the at least one guiding tube, and the flow guiding channel has cross-sectional areas with different sizes;

wherein a rotating center of the impeller and a center of the flow inlet are misaligned to each other, and the flow guiding channel is gradually shrunk along a direction from the accommodation space to the flow outlet.

9. The centrifugal fan according to claim 8, wherein the at least one guiding tube has an inner diameter gradually decreased along a direction from the accommodation space to the at least one flow outlet.

10. The centrifugal fan according to claim 8, wherein the at least one flow outlet comprises a first flow outlet and a second flow outlet, and the at least one guiding tube comprises a first guiding tube and a second guiding tube, wherein an axial line of the first guiding tube and the first flow outlet, and an axial line of the flow inlet and the impeller are extended in a same direction.

11. The centrifugal fan according to claim 10, wherein the first guiding tube, the second guiding tube and the first case are integrally formed into one piece.

12. The centrifugal fan according to claim 10, wherein the at least one flow outlet further comprises a third flow outlet and a fourth flow outlet, and the at least one guiding tube further comprises a third guiding tube and a fourth guiding tube, wherein an axial line of the third guiding tube and the third flow outlet and an axial line of the flow inlet and the impeller are extended in a same direction.

13. The centrifugal fan according to claim 12, wherein the at least one flow guiding channel comprises a first flow guiding channel and a second flow guiding channel, and the first flow guiding channel and the second flow guiding channel are located at two opposite lateral sides of the impeller, wherein he first flow guiding channel is in fluid communication between the accommodation space and the first guiding tube, and the second flow guiding channel is in fluid communication between the accommodation space and the third guiding tube.

14. The centrifugal fan according to claim 12, wherein the first guiding tube and the third guiding tube are detachably connected to the first side of the first case and located at two opposite lateral sides of the impeller.

15. The centrifugal fan according to claim 8, further comprising a pressurized assembly detachably connected to the flow inlet disposed on the second side, wherein the pressurized assembly comprises a connection part, a connection opening, a pressurized flow inlet and a pressurized tube, wherein the connection opening is disposed on an end of the connection part, spatially corresponds to the flow inlet, and is matched and connected to the flow inlet, wherein the pressurized tube is connected to another end of the connection part, the pressurized flow inlet spatially corresponds to the connection opening, and the pressurized flow inlet is in fluid communication with the connection opening and the flow inlet through the pressurized tube and the connection part, wherein a center of the pressurized flow inlet and a center of the connection opening are misaligned to each other.

16. The centrifugal fan according to claim 8, wherein the second case comprises a fifth guiding tube, a sixth guiding tube, a fifth flow outlet and a sixth flow outlet, wherein the fifth guiding tube is detachably connected to the second side of the second case, the fifth flow outlet is formed on an end of the fifth guiding tube, and the sixth flow outlet is formed on an end of the sixth guiding tube.

17. The centrifugal fan according to claim 8, wherein the at least one guiding tube comprises a connection end, and the connection end has an enlarged chamfer connected to the first side.

* * * * *